US006868781B2

(12) United States Patent
Dagher

(10) Patent No.: US 6,868,781 B2
(45) Date of Patent: Mar. 22, 2005

(54) COLOR PRINTING PRESS

(76) Inventor: Joseph G. Dagher, 12315 S. Benton Harbor Dr., Jacksonville, FL (US) 32225

( * ) Notice: Subject to any disclaimer, the term of this patent is extended or adjusted under 35 U.S.C. 154(b) by 0 days.

(21) Appl. No.: 10/254,165

(22) Filed: Sep. 25, 2002

(65) Prior Publication Data

US 2003/0164101 A1 Sep. 4, 2003

Related U.S. Application Data

(60) Provisional application No. 60/361,599, filed on Mar. 4, 2002.

(51) Int. Cl.[7] ..... B41F 7/02; B41F 5/00; B41F 13/10

(52) U.S. Cl. ..... 101/217; 101/177; 101/175; 101/183; 101/184; 101/216; 101/232; 101/365

(58) Field of Search ..... 101/217, 365, 101/177, 232, 175, 183, 184, 216

(56) References Cited

U.S. PATENT DOCUMENTS

| | | | | |
|---|---|---|---|---|
| 4,864,928 A | | 9/1989 | Maehara | |
| 4,945,830 A | | 8/1990 | Maehara | |
| 5,209,159 A | * | 5/1993 | Asanuma | 101/112 |
| 5,842,414 A | | 12/1998 | Yoshida et al. | |
| 5,909,708 A | | 6/1999 | Bolza-Schunemann | |
| 6,050,188 A | | 4/2000 | Bolza-Schunemann | |
| 6,062,136 A | | 5/2000 | Bolza-Schunemann | |
| 6,293,196 B1 | * | 9/2001 | DeMoore et al. | 101/424.1 |
| 6,302,018 B1 | * | 10/2001 | Aoyama et al. | 101/142 |
| 6,321,653 B1 | * | 11/2001 | Kobayashi et al. | 101/477 |
| 6,532,869 B2 | * | 3/2003 | Aoyama et al. | 101/177 |

FOREIGN PATENT DOCUMENTS

| | | |
|---|---|---|
| DE | 5435592 | 10/1926 |
| DE | 8521874 | 3/1931 |

* cited by examiner

*Primary Examiner*—Ren Yan
*Assistant Examiner*—Marvin P. Crenshaw
(74) *Attorney, Agent, or Firm*—Arthur G. Yeager

(57) ABSTRACT

A printing press performs offset color printing. A blanket cylinder having four image segments selectively contacts a plate cylinder having four image segments and an impression cylinder having five image segments for carrying print media. A pair of eccentric bushings for independently controlling the impression cylinder engages same to blanket cylinder. A print media feed system and a delivery system are located on the same side of the press and cooperate with each other via a means for moving feed and delivery trays in a generally vertical direction. Print media are gripped only once and travel in the same direction until let go by the impression cylinder. An image forming system forms four images on a plate cylinder to be inked by four respective inking units oriented therearound. All four plate image sections can be inked during one rotation of the plate cylinder. Four inking units including a minimal number of rollers for inking the plate image sections. Such an orientation of cylindrical image segments only discards the first three print media and can deliver a finished printed media by the fifth rotation of the impression cylinder.

26 Claims, 19 Drawing Sheets

COLOR PRINTING PRESS

CROSS REFERENCE TO RELATED APPLICATIONS

The present application is a continuation of prior U.S. provisional patent application Ser. No. 60/361,599 filed Mar. 4, 2002.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a printing press, and more particularly, a color printing press having a plate cylinder with four plate image segments, an impression cylinder with five impression segments, and a blanket cylinder with four blanket segments cooperating with the plate and impression cylinders for transferring offset images onto a print media.

2. Prior Art

Rotary offset printing machines incorporating prepress operations and printing operations into one printing press have been used for a number of years. The basic mechanisms, principles, and steps of operation for modern rotary printers can include image-exposure methods, image-ablation methods, computer-to-plate printing methods and other conventional printing methods known in the art. In computer-to-plate printing methods, an image is formed on an image plate by a laser exposure method, or the like, thereby performing the prepress image process with digital data. Such digital images may then be transferred onto printable media using conventional techniques, and magnetically charged ink-based systems, for example.

In conventional multi-color printing presses, the print media may be transferred to one or more impression cylinders, which grip the print media from a transfer gripper and roll the print media against one or more blanket cylinders for printing. Transfer cylinders and associated gears have been used to transfer print media from one impression cylinder to the next or from one blanket cylinder to the next. However, such structures are complex, expensive and introduce some problems.

For example, smearing can result because the printed surface of the transferred print media is directed inward on each transfer cylinder. The printed surface of the print media faces outward toward the blanket cylinder when the next impression cylinder grips it. Therefore, the need for special coatings, multiple transfer gripping mechanisms, special non-stick screens, large precision-built transfer cylinders, and even complex systems for air-cushioning the print media as it is carried around the transfer cylinder have been employed to minimize this smearing problem. As a result, the cost of manufacturing multi-color offset printers with such additional components has been very high.

Further, because of the need to properly adjust registration of the print media as it is received by each impression cylinder, transferred to each transfer cylinder and then received by each subsequent impression cylinder, the time and expense to set up any given multiple color offset printing job has been substantial. As a result, multiple color offset rotary printing has not been economically feasible for most small printing jobs requiring less than several thousand copies.

In summary, prior art prepress and printing machines require complex components and excessive floor space. The need for using several imaging heads, blanket cylinders, plate cylinders, and/or impression cylinders increases costs. Therefore, there is a need to provide a prepress and printing machine with fewer components to reduce the size thereof, associated costs and the efficiencies thereof.

BRIEF SUMMARY OF THE INVENTION

In view of the foregoing background, it is therefore an object of the invention to provide an efficient three-cylinder color printing press that requires minimal floor space and has low manufacturing costs. These and other objects, features, and advantages of the invention are provided by a color printing press including a rotatable blanket cylinder having four image segments, a rotatable plate cylinder having four image segments that are each selectively engagable with an associated blanket image segment. The press further includes an image forming system adjacent to the plate cylinder and for forming an image on each of the plate image segments.

The press further includes an inking unit for each of the plate image segments and for selectively supplying different color ink to the respective plate image segments, and rotatable impression cylinder having five image segments each including a gripper system for carrying a print media to receive an image thereon from at least one the blanket image segments. The impression and plate cylinders are rotatable in a single direction and opposite to rotation of the blanket cylinder.

The blanket cylinder has a pair of eccentric bushings at opposite ends thereof for simultaneously engaging and disengaging the blanket cylinder and the impression and plate cylinders. An axel extends through the longitudinal axis of the impression cylinder and is journaled at opposite ends thereof. A pair of spaced bushings are located at opposite ends of the axel and a pair of spaced eccentric bushings are adjacent the perimeter of the impression cylinder. A generally arcuate support member cooperates with the axel and the pairs of bushings and eccentric bushings for selectively engaging the impression cylinder against the blanket cylinder. Accordingly, the impression cylinder is engagable against the blanket cylinder at a different time from when the blanket cylinder engages the plate cylinder.

Each of the inking units includes a plurality of rollers cooperating with each other so that one of the plurality of rollers selectively engages one associated plate image segment. The one roller of each of the inking units is a form roller having a circumferential length substantially equal to a circumferential length of each of the associated plate image segments. The inking units are oriented in a generally satellitic path around about a 180 degrees periphery of the plate cylinder and remote from the blanket cylinder. The image forming system includes an imaging unit adjacent the plate cylinder for creating an image on each of the plate image segments. The imaging unit is generally between one of the inking units and the blanket cylinder.

The printing press may further include a coating apparatus for applying an aqueous solution on printed media after receiving a predetermined number of color images thereon and prior to being discharged from the impression cylinder. A print media feed system and a print media delivery system is disposed generally below the feed system and located adjacent the impression cylinder. The feed system transports print media to the impression cylinder and the delivery system receives and discharging printed media from the impression cylinder.

The feed and delivery systems may be located generally on opposite sides of the printing press. Likewise, a print media feed system and a printed media delivery system is disposed generally above the feed system and is located adjacent the impression cylinder. The feed system is for transporting print media to the impression cylinder and the delivery system is for receiving and discharging printed media from the impression cylinder. A dryer may be adjacent to the delivery system for drying the aqueous solution before the delivery system releases printed media.

Alternately, the feed and delivery systems may be located generally on the same side of the printing press adjacent the impression cylinder. The feed and delivery systems respectively further include a feeder tray and a delivery tray located generally thereabove and means for connecting each of the trays for vertical movement. The feeder tray is movable upwardly to dispose print media into position for entering and attaching to the impression cylinder and the delivery tray is movable downwardly as printed media is deposited on the delivery tray.

The delivery system further includes a pair of rotatable cylinders, a delivery chain connecting the pair of rotatable cylinders and a plurality of gripper systems so that a first one of the plurality of gripper systems is attached to one of the pair of cylinders cooperating with the impression cylinder for removing printed media therefrom. A second one of the pair of plurality of gripper systems is attached to the delivery chain for delivering printed media to the delivery tray. Each of the blanket and plate image segments has substantially the same circumferential length and the longitudinal axis of the plate cylinder is above the longitudinal axis of the impression cylinder, which is above the longitudinal axis of the blanket cylinder. The longitudinal axes of the plate and blanket cylinders are parallel and form an angle of about 120 degrees with the plate cylinder axis being an apex.

The press further includes a machine frame for housing the press, which is approximately 10.7 feet long, 3.5 feet wide, and 6.5 feet high thereby allowing easy access to the feed and delivery trays. At least one door movably attaches to the frame for accessing select components of the press when the door is at an open position.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
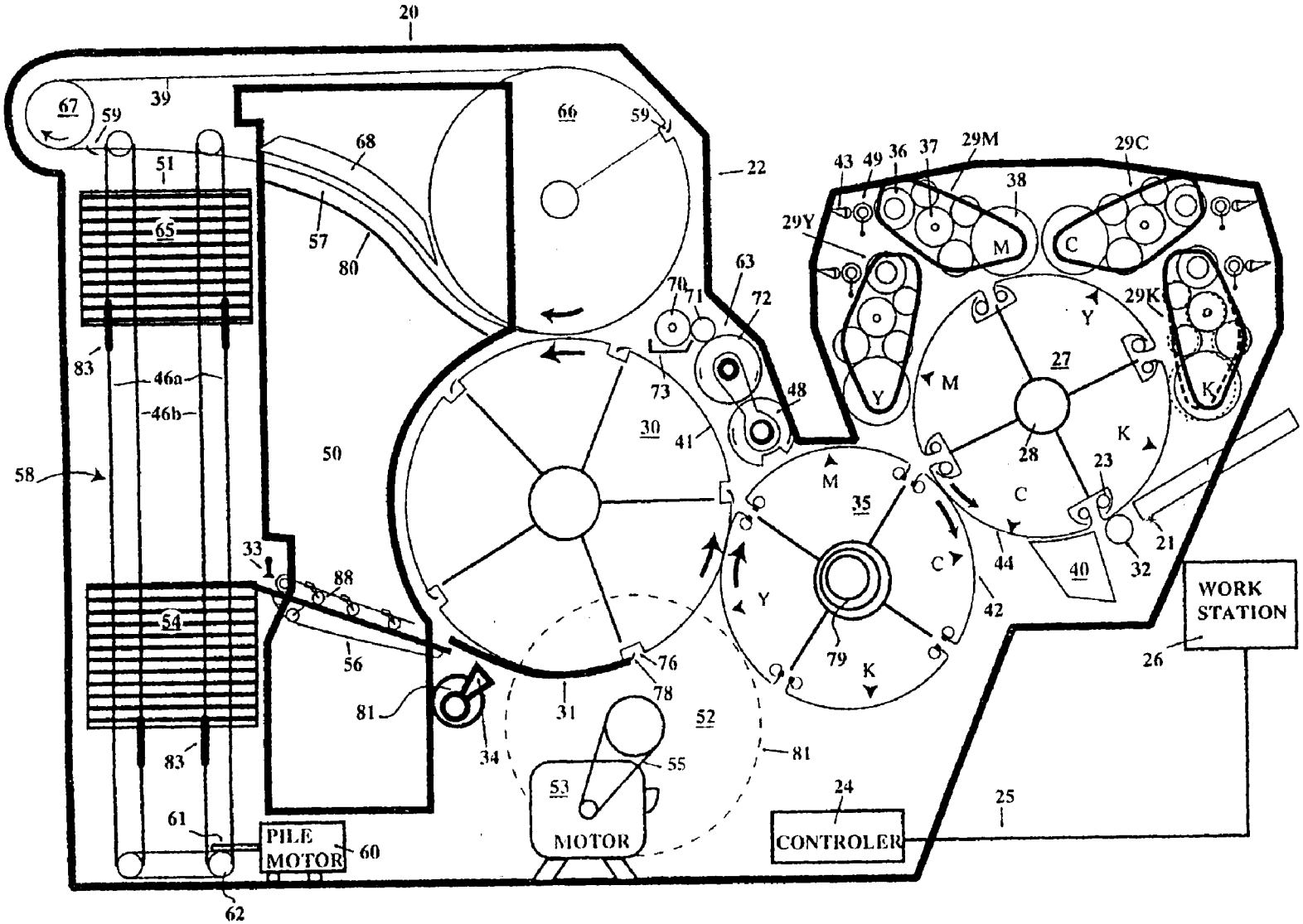
FIG. 1 is a side elevational view of a "DP 420" printing press including a controller and workstation in accordance with the present invention.
Figure 2:
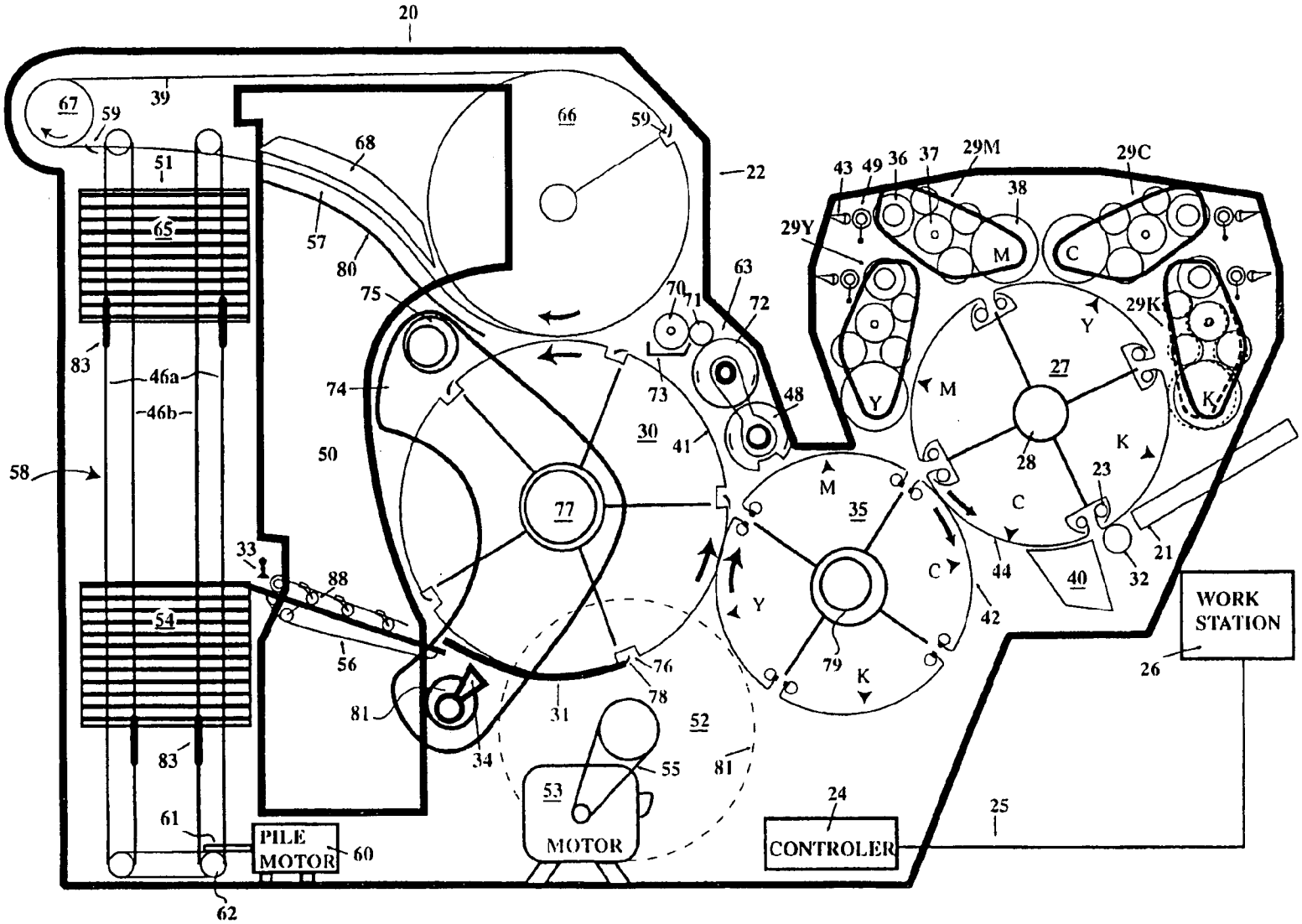
FIG. 2 is an enlarged side elevational view of a "DP 420 plus" printing press, which is an alternate embodiment of the printing press shown in FIG. 1.
Figure 7:
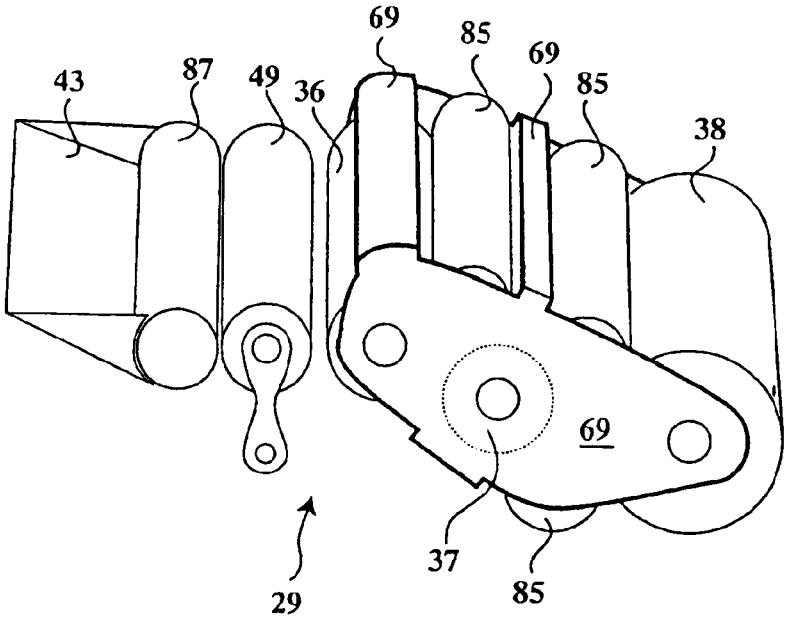
Figure 6:
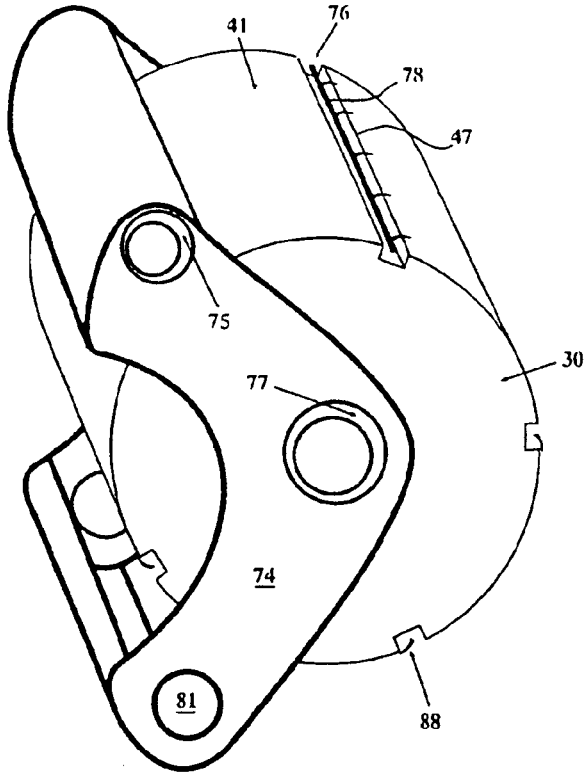
Figure 8:
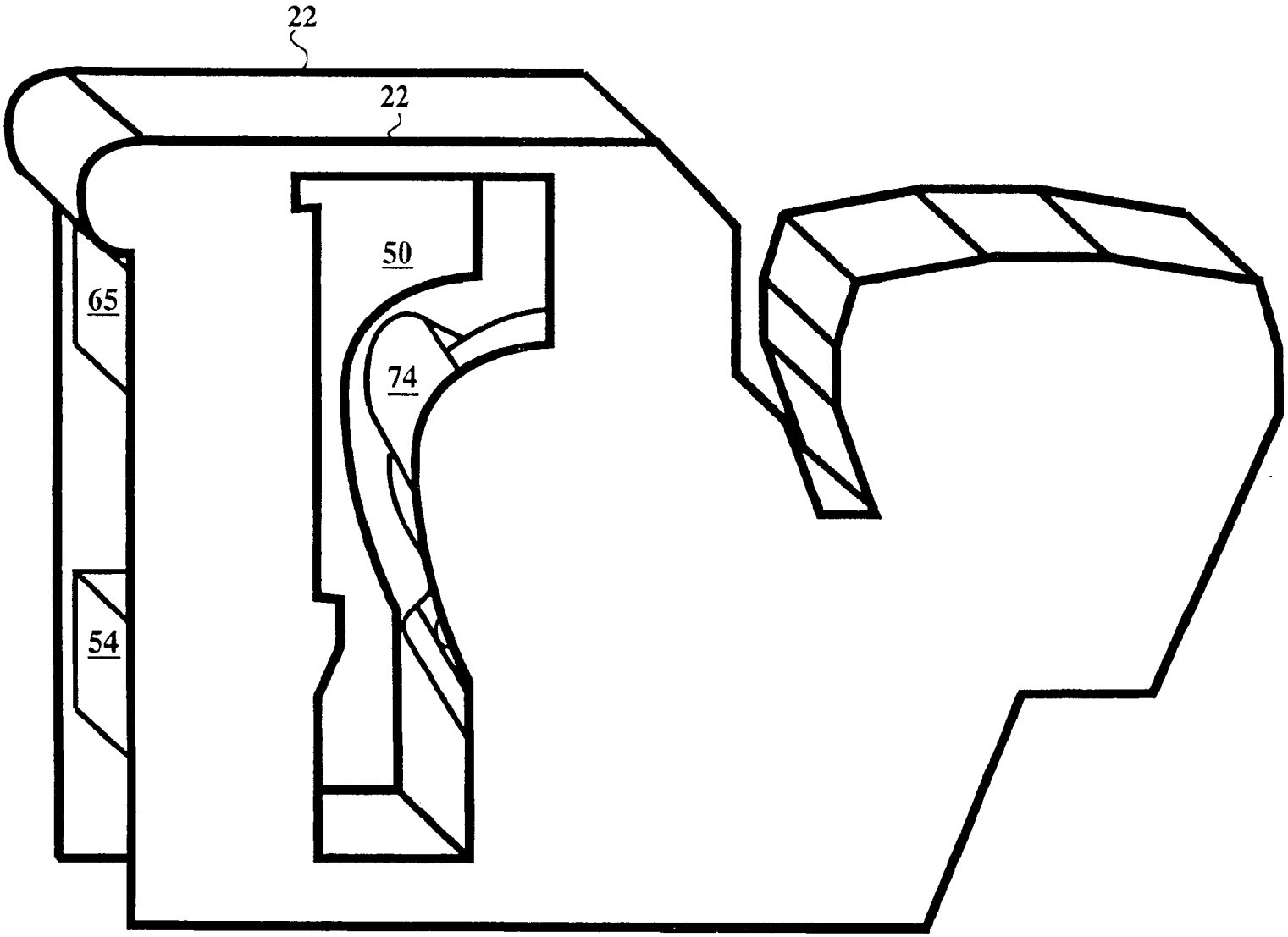
Figure 9:
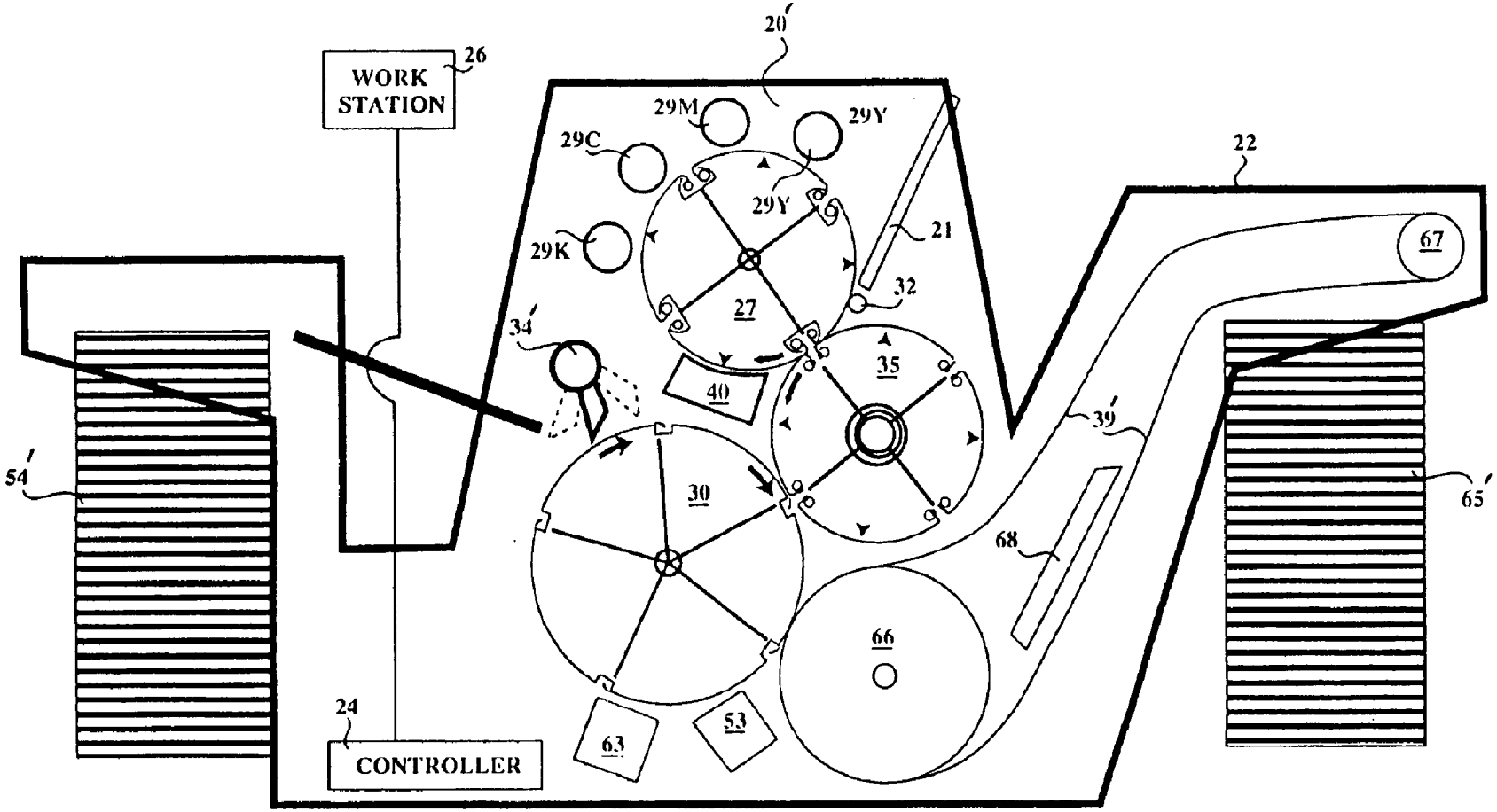

FIGS. **5A–5*j* illustrate the printing process for each one-segment movement of the impression, blanket, and plate cylinders associated with the printing press shown in FIG. 2**;

FIG. 6 is an enlarged perspective view of the impression cylinder assembly and plurality of eccentric bushings shown in FIG. 2;

FIG. 7 is an enlarged perspective view of an inking unit shown in FIG. 1;

FIG. 8 is an enlarged perspective view showing the general shape of the frame that houses the printing press shown in FIG. 2; and FIG. 9 is a side elevational view showing an alternate embodiment of the printing press shown in FIG. 1.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout.

Referring initially to FIG. 1, the present embodiment of a printing press is illustrated as a freestanding four-color rotary offset printing press 20, DP 420. The components of the press 20 are mounted within an upstanding, two-sided machine frame 22, which normally is supported by a floor of a building and is only about 10.7 feet long, 6.5 feet high, and 3.5 feet wide, for example. A controller 24 receives digital input data and control signals from a separate workstation 26 connected thereto by a conventional communication bus 25. Press 20 can respond to digital signals representing images and since the press is a four-color press, up to four separate strings of image signals may be involved for representing the color separations for yellow, cyan, magenta and black.

Figure 4:
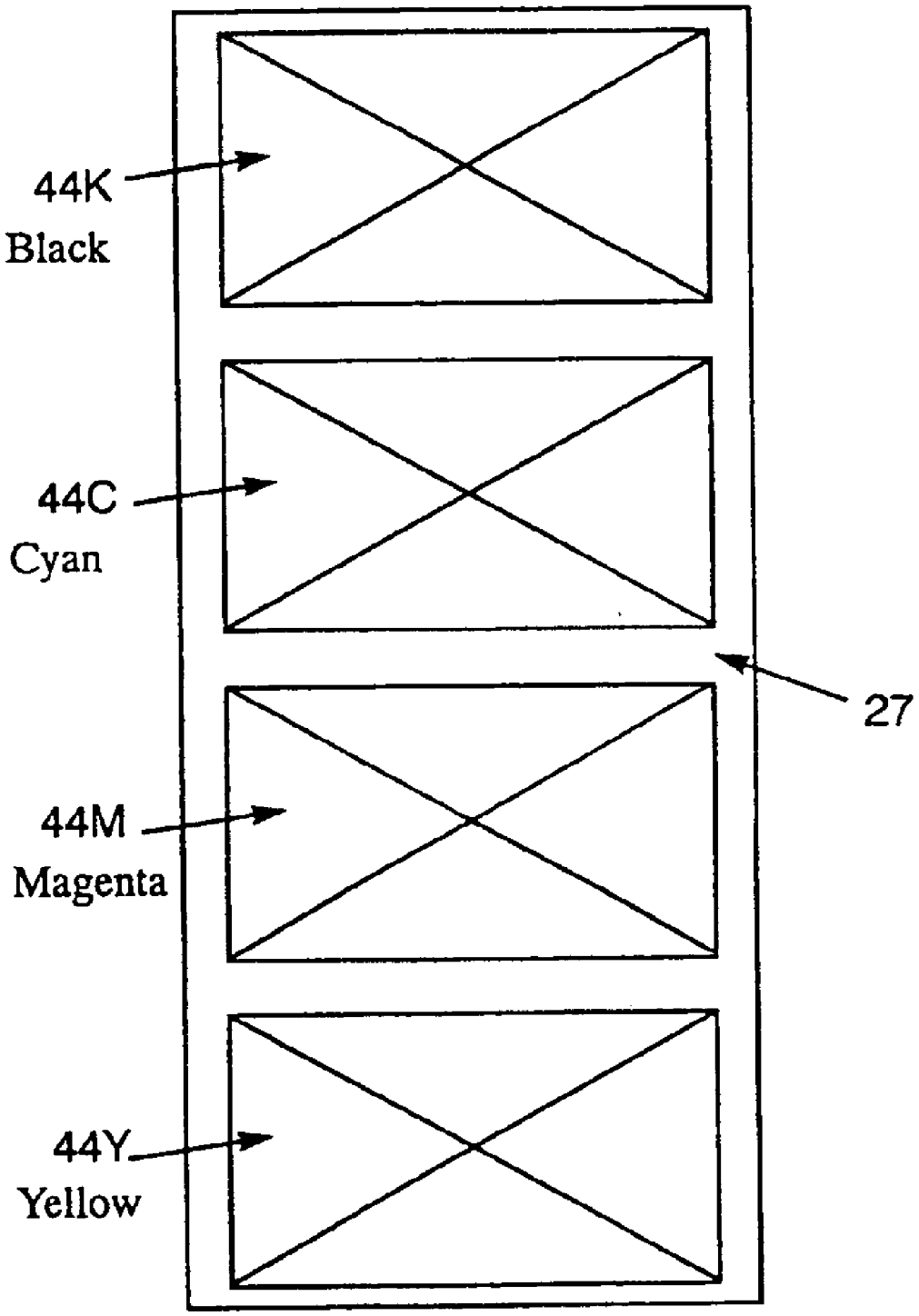
FIG. 4 is an enlarged top plan view of the four image segments on the plate cylinder surface, which is shown as a flat surface for better visualization.

These image signals may be stored on a disk and transferred to the press 20 via a disc drive at workstation 26. Alternately, they may arrive from a computer, telephone line or other compatible electronic source. An operator enters the image signals, i.e. instructions relating to press control such as ink flow adjustment, number of copies to be printed, etc, via a keyboard at the workstation 26. Other instructions may be entered for imaging the printing plates 44Y, M, C, K (shown in FIG. 4) that can be releasably mounted on cassette 21 or in polyester spool film plates 23, for example, in a manner well known in the art. As perhaps best shown in FIG. 8, an access door(s) 50 may be provided on one or both sides of the frame 22 and are shaped such that opening the door(s) 50 provides visual and physical access to select components contained in frame 22, as well as the print media 31 and printed media 51.

Referring back to FIG. 1, a print media feed and delivery system 58 includes an array of pulleys 62, mounted to the machine frame 22, around which are one or more chains 46*a,* 46*b.* The pulleys 62 and chains 46*a,* 46*b* extend in a substantially vertical direction from approximately the bottom to the top of the printing press 20. A lower tray or print media feed tray 54 houses print media 31 and an upper tray or delivery tray 65 houses finished printed media 51. Such trays cooperate with each other for feeding print media 31 to and delivering printed media 51 from the impression cylinder 30. Thus, only one motor 60 and mechanical shaft 61 are needed to power the pulleys 62.

Feed sucker(s) 33 is located away from the chains 46*a*, 46*b* so that as print media 31 is dispatched from lower tray 54, same rises and upper tray 65 lowers proportionally. If the feed tray 54 is stopped or disengaged or when running a new set of image plates, the delivery tray 65 can be lowered to serve as the feed tray 54 particularly when double-sided printing is required, thus automatically positioning the full printed media 51 to be fed through the press 20 for the second pass.

As perhaps best shown in FIG. 6, cylinder 30 is provided with a circumferential array of clamping or gripping systems shown generally at 76, as well known in the art. Each system 76 may include a plurality of grippers, which are rotatively mounted by pivots at one end thereof to an elongate gripper bar 78. The opposite ends of the grippers are thus free to swing radially in and out about the gripper bar 78. When the free end of each gripper is in its outer position, it is able to receive or intercept the leading end of a print media 31. On the other hand, when the free end of each gripper is in its radially inner position or closed position, it lies generally flush with the surface of the cylinder 30.

Referring back to FIG. 1, before a gripper is advanced opposite to the paper feed guide 56 of the print media 31, that gripper is ready to receive the leading end of the print media, which is being advanced by the feeder swing system 34 to impression cylinder 30. Immediately thereafter, the gripper system 76 snaps back to its closed position thereby gripping that print media 31 so that same becomes wrapped about the rotating cylinder 30. Paper feed guide 56 may include a moving belt carrying a plurality of rollers 88 for aligning and feeding print media 31 to the impression cylinder.

The impression cylinder 30 has at least as many gripper systems 76 as there are inking units 29Y, M, C, K (discussed below). In particular, cylinder 30 has five such gripper systems 76, the extra one being for an extra print media 31 fed and delivered from the impression cylinder 30 thereby allowing each print media 31 to receive different color images while rotating around the impression cylinder 30. The five such gripping systems 76 are distributed at equal angles around the cylinder 30, so that each gripping system 76 is associated with an impression cylinder image segment 41 having equal circumferential lengths and each capable of holding print media 31 for printing. After the first printed media 51 is complete, each time a print media 31 is fed to an image segment 41 and is gripped by a gripper system 76, that print media 31 is not released from the cylinder 30 until all four inking units 29K, C, M and Y transfer an image thereon via corresponding blanket cylinder image segments 42K, C, M and Y (discussed below).

As noted above, the impression cylinder 30 is of a size to allow the four blanket image segments 42 to print four different color images on at least four separate print media 31 carried thereby. To accomplish this effectively and efficiently, it is essential that the relative positions of the print media 31 be precisely known and controlled. Otherwise, the four different color images printed on the print media 31 may be out of register with respect to each other. Although, during sample test runs, the swing system 34 precisely placed each print media 31 in identical positions and no images were printed out of register.

Advantageously, because the print media 31 are mounted on a single large impression cylinder 30 while being printed on by the four blanket image segments 42, which is mounted on one cylinder 35, contributes greatly to the ability of printing press 20 to print the different color components of each image in register. In addition, because each print media 31 is gripped at the surface of cylinder 30 only once, the position of that print media is fixed while being rotated into contact with the blanket image segments 42 of all four inking unit 29K, C, M and Y colors. Only then is the printed media 51 released to the delivery system 57 for drying and/or delivery to tray 65. This is in sharp contrast to prior serial-type presses, which grip and release each print media at separate impression cylinders for each or for a pair of inking units arranged in series.

As previously noted, multiple gripping or handling of each prior art print media can cause variations in the position thereof from cylinder to cylinder. These positional variations tend to be more or less random and, therefore, are difficult to minimize either mechanically or electronically. The usual solution has been to try to minimize the problem by resorting to complex and expensive feeding and positioning mechanisms at the various inking units. However, such a solution is not feasible here where one of the prime objectives is to provide a relatively low cost printing press that can print high quality copies while taking up minimal floor space. The prior art problems are therefore avoided in accordance with this invention.

The blanket cylinder 35 of the DP 420 printing press has a longitudinal axle journaled by eccentric bushing(s) 79 at least on one or on opposite sides of the machine frame 22. The blanket cylinder 35 may selectively contact impression cylinder 30 for impressing an offset printable image, received from the plate cylinder 27, onto a print media 31 revolving with cylinder 30. Gears (not shown) drive the equal and same size blanket image segments 42 and plate image segments 44. Each gear has a circumferential length substantially equal to a blanket image segment 42. A driving gear 52 powered by a motor 53, via a plurality of belts 55, rotates the gears.

Alternately, as shown in FIG. 2, the DP 420 plus printing press allows the impression cylinder 30 to engage the blanket cylinder 35 independent of the movement of plate cylinder 27 for engaging blanket cylinder 35. As perhaps best shown in FIGS. 2 and 6 a support member 74 cooperates with a pair of opposed eccentric bushings 75 and bushing 81, spaced adjacent the perimeter of impression cylinder 30 for independently engaging impression cylinder 30 to blanket cylinder 35. Member 74 is mounted or anchored to frame 22 on the stationary bushing side of the feeder swing device 34 and is aligned by the adjustable eccentric bushing 75. Bushing 77 secures the impression cylinder in a parallel alignment, about a central axle, for evenly engaging blanket cylinder 35. Advantageously, when the blanket cylinder 35 initially engages plate cylinder 27, impression cylinder 30 can remain disengaged from blanket cylinder 35 until same receives images from plate cylinder 27. This advantage will reduce unnecessary print media 31 waste before the first printed media 51 is finished.

Referring to FIGS. 1 and 2, the plate cylinder 27 is in an abutting relationship with the blanket cylinder 35. The plate cylinder 27 is rotatively mounted inside frame 22 and has a central longitudinal axle 28 journaled at opposite sides of the machine frame 22. Preferably, cylinder 27 is approximately twenty-one inches in diameter and sixty-eight inches in circumference equaling the circumference of the blanket cylinder 35. Disposed around cylinder 27 are four substantially identical inking units 29Y, 29M, 29C and 29K which print four respective colors yellow, magenta, cyan and black onto the corresponding plate image segments 44Y, M, C, K, as perhaps best shown in FIG. 4. Preferably the inking units are supported by frame 22 in a generally symmetrical arrangement spaced about plate cylinder 27, as shown in FIG. 2. Of course, the different colors of the inking unit 29Y, M, C, K can be changed to other colors.

A section of cylinder 27 is in an abutting relationship with the form roller 38 for inking the plate image segments 44Y, M, C, K, such as the print plates used when mounting and demounting metal printing plates from cassette 21, for example. Such metal plates can be pressed against the outer surface of cylinder 27 via the metal plate tension roller 32. Roller 38 has a substantially cylindrical shape selectively extending along a portion of the length of cylinder 27 and journaled at opposite walls of the frame 22 along the outer surface of cylinder 27.

As perhaps best shown in FIG. 7, each inking unit 29Y, M, C, K includes a conventional ink fountain 43, preferably including means for automatically controlling ink flow so that the amount and distribution of ink applied to the plate image segments 44Y, M, C, K can be regulated by signals sent from the controller 24. Each inking unit 29Y, M, C and K is slidably or pivotably mounted on machine frame 22 so that its associated form roller 38 can be moved into or out of contact with the corresponding image segment 44, best shown in FIGS. 1 and 2. In addition, each inking unit 29Y, M, C and K includes a metering roller 36, serving as the pivoting axis and cooperating with guide rollers 85, 85', 85" and isolator roller 37 for spreading a smooth and even ink layer to form roller 38. Each guide roller 85, 85' and 85" preferably has a different circumference and do not contact each other.

A lever (not shown) is controlled by either the plate 27 or blanket 35 cylinders and engages the group of rollers housed by the inking unit frame 69. Such rollers are controlled by two pairs of opposed mechanical cams (not shown) mounted on a four-segment cylinder (not shown). Such a cylinder positions an eccentric or off-center bushing or bearing (not shown) in contact with an inking unit thereby allowing the form roller 38 to contact the desired plate cylinder segment 44. Each inking unit 29 is housed by a frame 69 and may also include a vibration isolator roller 37, shown in FIG. 7, for preventing errors during inking.

The form roller 38 attaches at an end of the inking unit 29 via an axle passing through its longitudinal axis. Each form roller 38 has a circumferential length equal to the circumferential length of one plate image segment 44 to help prevent ghosting. A ductor roller 49, known in the art, acts similar to a conventional ink train, provides the flexibility of using any requisite ink color neither limited by the container, nor cartridge size, nor the method of dispensing ink contained therein.

The above described inking unit 29Y, M, C and K components are synchronized with each other and are rotated via gears (not shown) for engaging rubber and to the steel rollers. Advantageously, each inking unit 29Y, M, C and Y uses a minimal number of isolator rollers 37 for minimizing the amount of space needed to house the inking units 29Y, M, C and K inside the machine frame 22.

Further, such inking units allow the inking of lithographic waterless plates (not shown), for example, by a scanning or imaging unit 40 when a plate is mounted on the plate cylinder 27, as well known in the art. The imaging unit 40 may be any type of device such as a laser, diodes, magnetic electrodes, magnetic charge, etc. capable of altering the surface of the plate housed by the plate image segment 44 so as to impress an image thereon.

Referring to FIGS. 1 and 2, as described above, the plate cylinder 27 may be adjacent to a plate material cassette 21. Such a cassette may contain a length of imagable flexible plate or film that can be automatically advanced around the plate cylinder 27 to locate fresh lengthwise image segments 44. Each plate may bend and conform to the shape of cylinder 27. Accordingly, any plate image can be created very quickly and efficiently using one imaging unit 40. After use, the old image may be rolled up inside of the plate cylinder 27 at the same time as the new material is dispensed, as well known in the art. Such a rolling-up feature can also be used with plate-less technology.

The plate image segment 44 carrying the image of the original document or picture to be copied may be inked in conventional ways by inking units 29Y, M, C and K. For certain types of lithographic plates, for example, the inking units coat both water and ink onto the plate surfaces. Other types of well-known plates that receive special ink or are temperature controlled (not shown), do not require water and accordingly, such a component of the inking units 29Y, M, C and K may be disabled or deactivated. Of course, whether wet or dry lithography methods are employed, for example, the objective is to transfer an inked image from the plate cylinder 27 via the blanket cylinder 35 to the print media 31 on impression cylinder 30, in accordance with the present invention.

An aqueous coating device 63 includes a form roller 48 having a circumference equal to the circumferential length of an impression cylinder image segment 41. A conventional tensioning device (not shown) may be adjusted around roller 70 for sweeping up the aqueous coating solution from a reservoir 73, as known in the art. The aqueous solution is transferred onto rollers 70, 71, 72 and finally onto application or form roller 48. The form roller may selectively engage a finished printed media 51 after the printed media receives all the desired color images thereon. The printing process described hereinbelow is for the DP 420 Plus, which can independently engage the impression cylinder 30 with the blanket cylinder 35 at a later time than when the blanket cylinder 35 engages the plate cylinder 27. Furthermore, although the impression cylinder 30 appears to be engaged with the blanket cylinder 35 in all of the figures, it is to be understood that the impression cylinder 30 selectively engages the blanket cylinder 35 as described hereinbelow.

A lever (not shown) controlled by a mechanical cam is driven by a four-segment cylinder that positions an eccentric or off-center bushing to move the form roller 48 into contact with the printed media 51. Accordingly, if required, the coating device 63 can apply the aqueous solution onto a finished printed media 51 before the delivery system 57 grabs the printed media 51. Once the delivery system 57 grabs the printed media 51, same is passed via delivery chain 39 under a dryer and released onto a stack of printed media in delivery tray 65, once per revolution of the blanket cylinder 35. Of course, the coating device 63 may be selectively employed when needed.

Figure 3:
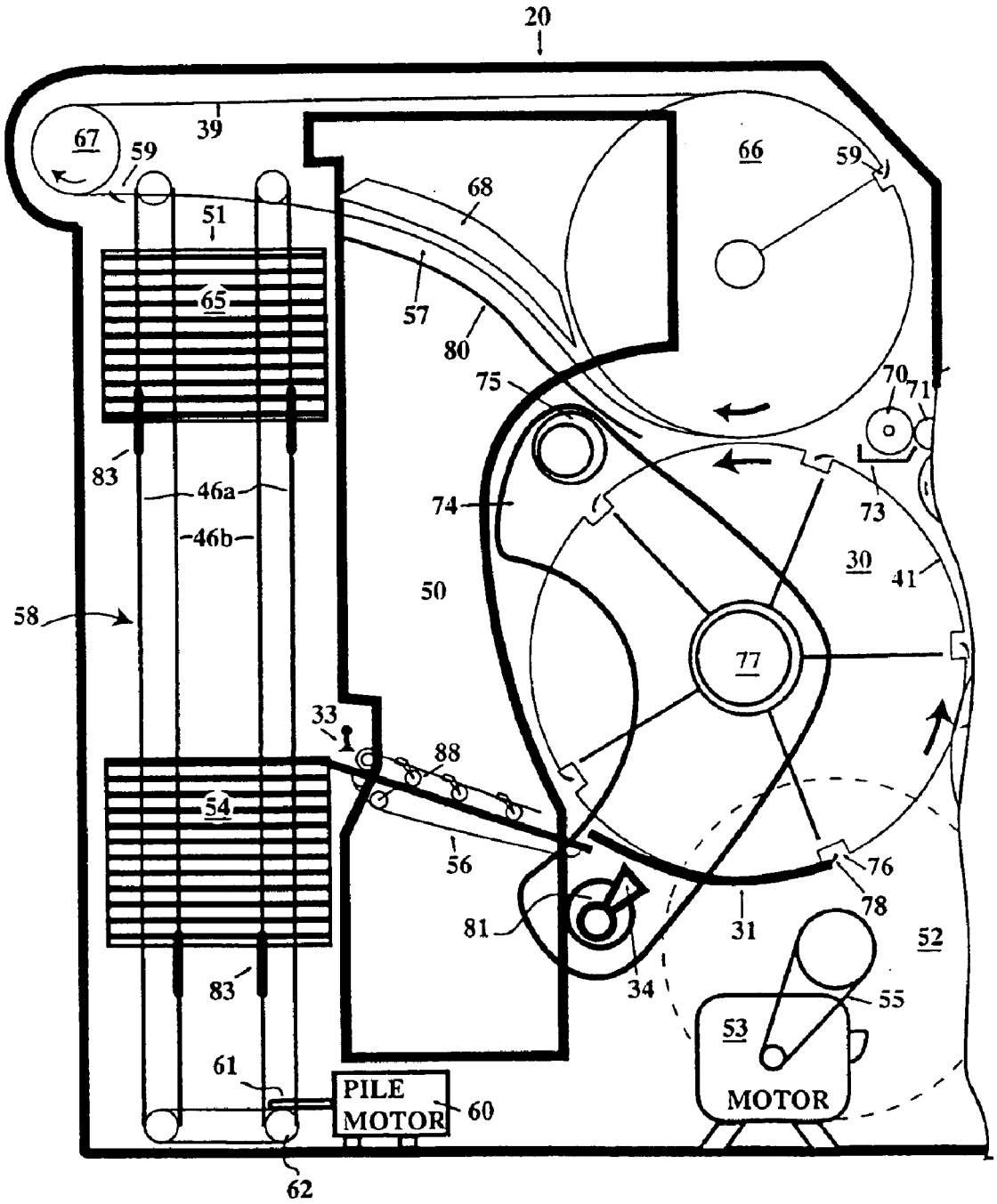
FIG. 3 is a partial side elevational view of the printing press shown in FIG. 2 and illustrates a one-directional printing path associated therewith.

The delivery system 57, as perhaps best shown in FIG. 3, transfers printed media 51 to the delivery tray 65 located on the same side of the press 20 above feeder tray 54. The delivery system 57 may include a transfer and pulley roller 66, 67, respectively, carrying a delivery chain 39 that transports gripper at least on gripper system 59 thereon. Such a gripper system pulls the leading end of a finished printed media 51 from the surface of cylinder 30 and is similar to the gripper system 76 housed on cylinder 30. Of course, the delivery system 57 may include other known components such as print media guides, different suction devices, etc. to facilitate loading and offloading the printed media 51.

Transfer roller 66 has a circumferential length equal to the circumferential length of the plate 27 and blanket 35 cylinders. In fact, such cylinders are synchronized with the cylinder 30 and transfer rollers 66, 67 so that two gripper systems 59 can be carried by the delivery transportation system 57 for picking up printed media 51 from cylinder 30 after each rotation of the plate 27 and blanket 35 cylinders, once the first printed media 51 is finished. A conventional dryer 68 is located generally between the roller 66 and the delivery tray 65 along the path of the delivery chain 39. As the printed media 51 is transported along delivery chain 39, it passes beneath the dryer 68 for drying the ink or the aqueous coating applied thereon by the coating device 63 and/or ink images thereon, as needed. Of course, dryer 68 can be turned on and off as necessary. A shield 80 extends generally between the impression cylinder 30 and delivery tray 65 for protecting printed media 51 from debris while being dried and/or transported therebetween.

In the DP 420 plus, FIG. 2, respectively, the print media 31 path is approximately 35 feet long depending on the nominal size of each impression image segment 41. As perhaps best shown in FIG. 3, the portion of the print media 31 path along the circumference of the impression cylinder 30 is in one rotating direction and is scratch-free, touch-free, and offset-free while being engaged by only one gripper system 76 when carried thereon. Such a one-direction print media 31 path allows printing of onion-skin to 32-point thick print media, including envelopes and the like. The DP 420, FIG. 1, can print up to 24-point thick print media.

In an alternate embodiment, as shown in FIG. 9, the feed and delivery trays 54', 65' are located at opposite ends of the press 20'. Accordingly, the orientation of the plate, blanket and impression cylinders 27, 35, 30 is different. In particular, the longitudinal axis of the plate cylinder 27 forms an angle of approximately seventy degrees with the longitudinal axis of the blanket cylinder 35, with the axis of the plate cylinder 27 being the apex. Additionally, the longitudinal axis of the impression cylinder 30 is below the longitudinal axis of the blanket cylinder 35 and the feeder swing device 34' that is spaced from generally the fourth quadrant of the impression cylinder 30.

Thus, as the feeder swing device 34' feeds print media 31 onto impression cylinder 30, the print media 31 travel in a clockwise direction while receiving images from blanket cylinder 35. This clockwise motion is opposite to the counter-clockwise motion of impression cylinder 30 in FIGS. 1 and 2. However, in all three embodiments described above, FIGS. 1, 2 and 9, the plate and impression cylinders 27, 30, respectively, rotate in the same direction to each other and opposite to the rotation direction of the blanket cylinder 35. Referring back to FIG. 9, the delivery chain 39' and rollers 66, 67 are opposite the feed system 54' and adjacent the delivery system 65'. Accordingly, the printed media 51 travel in a generally upward direction for drying and are delivered to the opposite end of the feeder tray 54'.

Printing Process

Figure 5A:
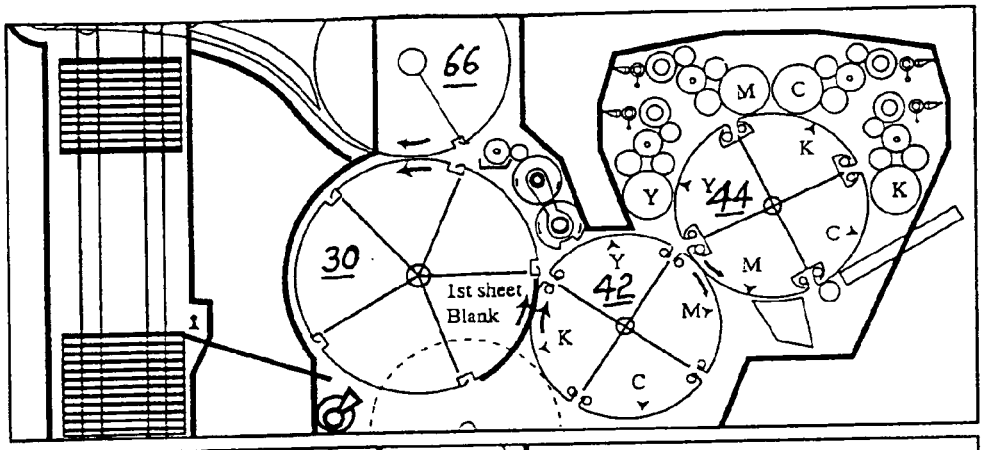
Figure 5B:
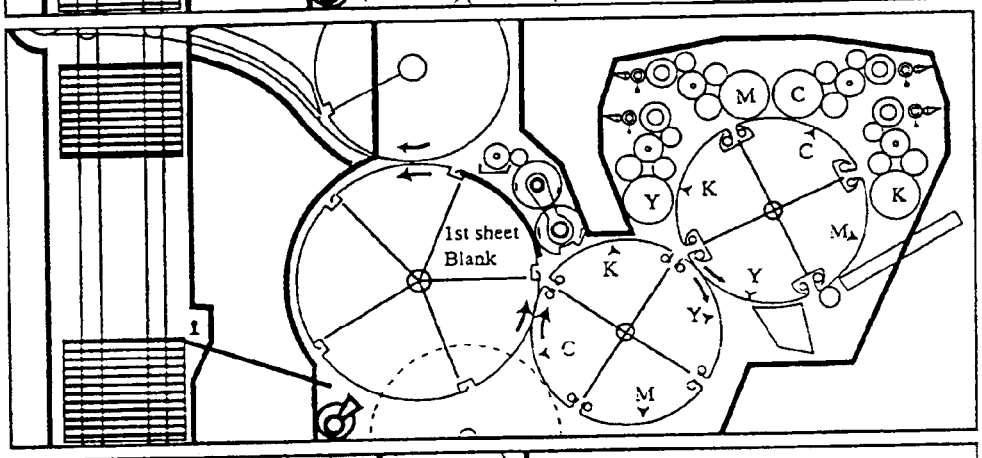
Figure 5C:
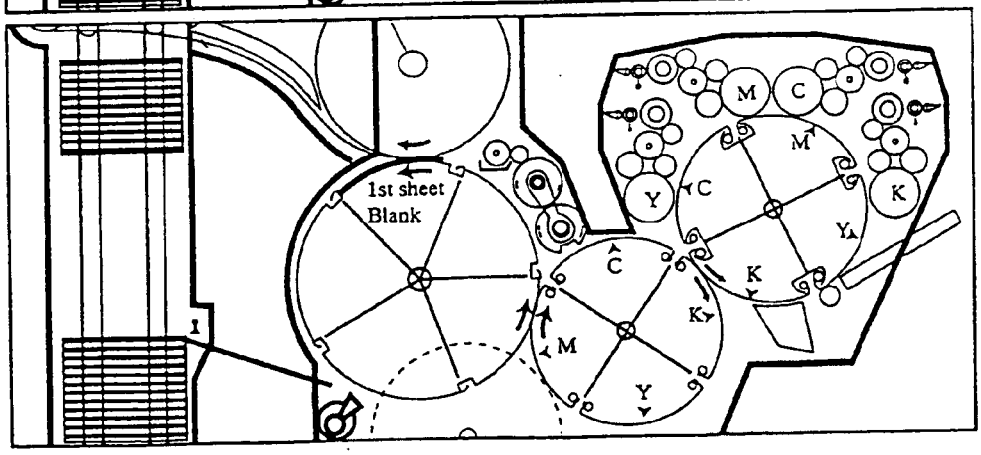
Figure 5D:
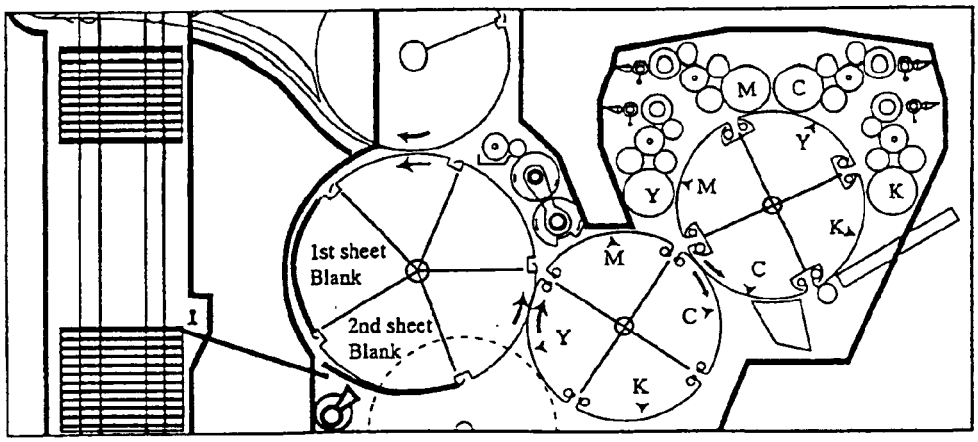
Figure 5E:
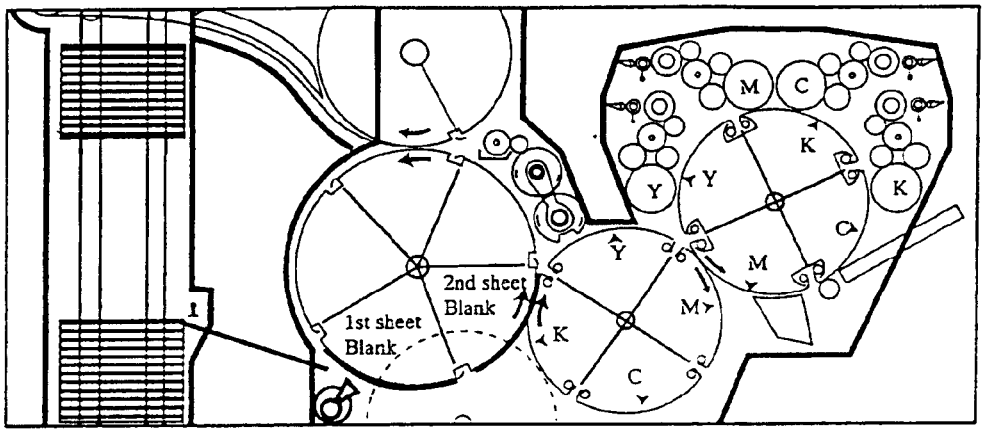

A step-by-step analysis representing the sequence of events of the printing process is illustrated in FIGS. 5A~**5*j*. Each figure represents a one-segment rotation or ¼ turn on the plate and blanket cylinders 27, 35 and a one-segment or ⅕ turn on the impression cylinder 30. For better visualization and convenience, FIG. 5*a* shows the location of the first print media 31 after it has been rotated ⅕ turn from FIG. 1 and being engaged with blanket cylinder 35 with no ink thereon. The printing process described hereinbelow is representative of the embodiment for the DP 420 Plus printing press. The DP 420 printing process is simpler because the blanket cylinder 35 engages the impression 30 and plate cylinders 27 simultaneously, as will be appreciated by those skilled in the art. Further, although the figures show the impression cylinder 30 engaged with the blanket cylinder 35 at all times, such is not the case. It is to be understood that the impression cylinder 30 is independently engagable with the blanket cylinder 35**. Accordingly, the drawings should serve as a reference for the written description hereinbelow.

Accordingly, the events preceding FIG. 5A are as follows: the print media feed system 58 feeds a print media 31 to a registration station (not shown). At this station, the leading edge of the print media 31 is stopped by movable fingers (not shown) and registers the print media to be parallel to a longitudinal axis of the impression cylinder 30. Once this is done, the print media 31 is moved toward a side guide (not shown) by conventional means to assure that the print media has been squared up and is in the correct axial position relative to the impression cylinder 30.

Before the cylinder 30 grips print media 31, the leading end of the print media is guided by a feeder swing system 34 for accelerating the print media 31 to approximately the surface speed of cylinder 30. Thus, just before each print media 31 reaches the cylinder 30, the leading end segment thereof is accelerated directly toward the surface of cylinder 35 to allow a smooth transition onto the surface thereof and to prevent creasing or tearing of the print media 31. The gripper system 76 is in a ready or open position to lock onto the print media 31 as it is transferred onto the impression cylinder 30.

Now referring to FIG. 5A, the first print media (shown as $1^{st}$ sheet blank) is held on the impression cylinder 30 while the impression cylinder is disengaged or not yet in contact with the blanket cylinder 35 and as the first print media continues on its path around the cylinder 30. After four image segments 41 have passed around the impression cylinder 30, as shown in FIGS. 5A–5D, a second print media 31 is fed to occupy the image segment in front of the first print media. During the second rotation around the cylinder 30, the second print media will continue a four-segment path while cylinder 30 is still disengaged from blanket cylinder 35, shown in FIGS. 5D–5H.

Figure 5F:
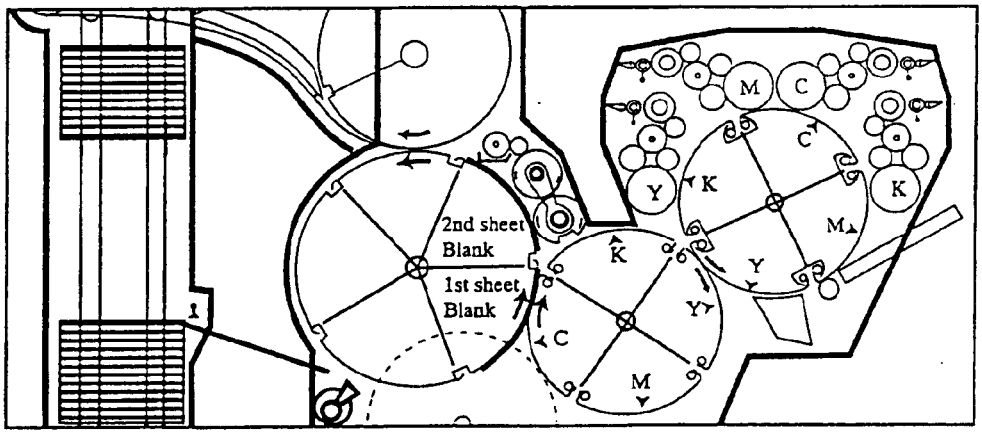
Figure 5G:
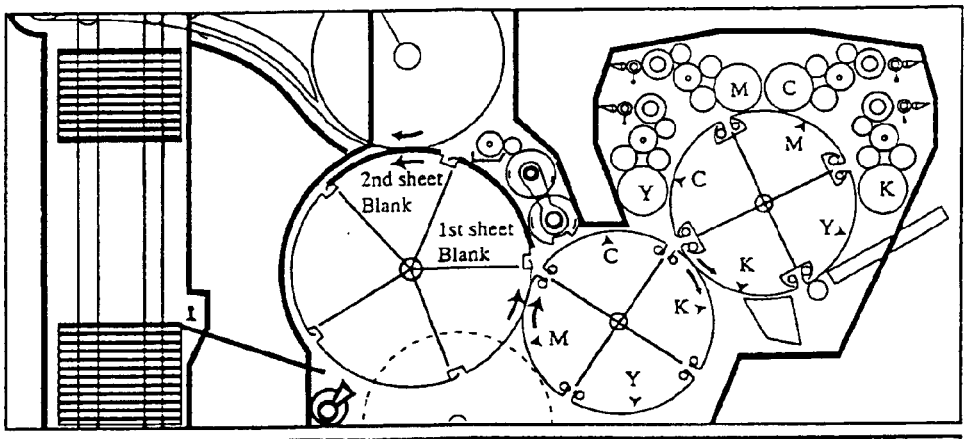
Figure 5H:
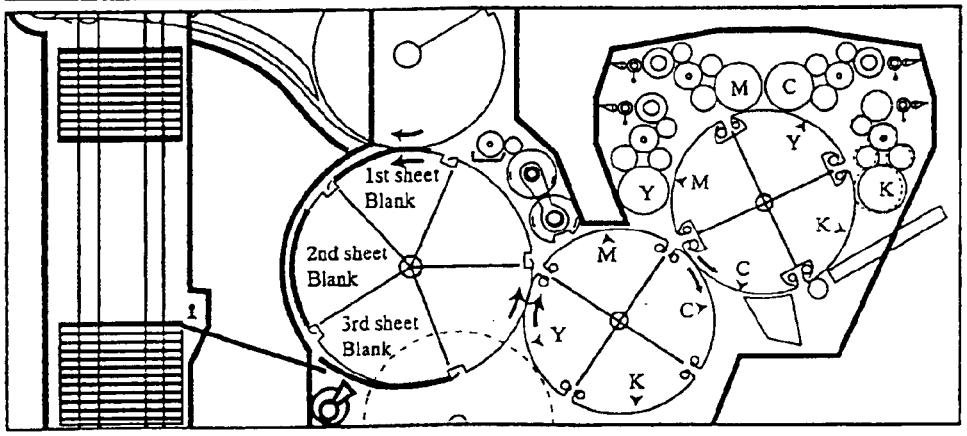

Referring to FIG. 5H, a third print media is entered to occupy the image segment in front of the second print media after four image segments have passed on the impression cylinder 30. Meanwhile, at a specific time, the black inking unit 29K is engaged to begin inking the black color image on the corresponding plate cylinder image segment 44K.

Figure 5I:
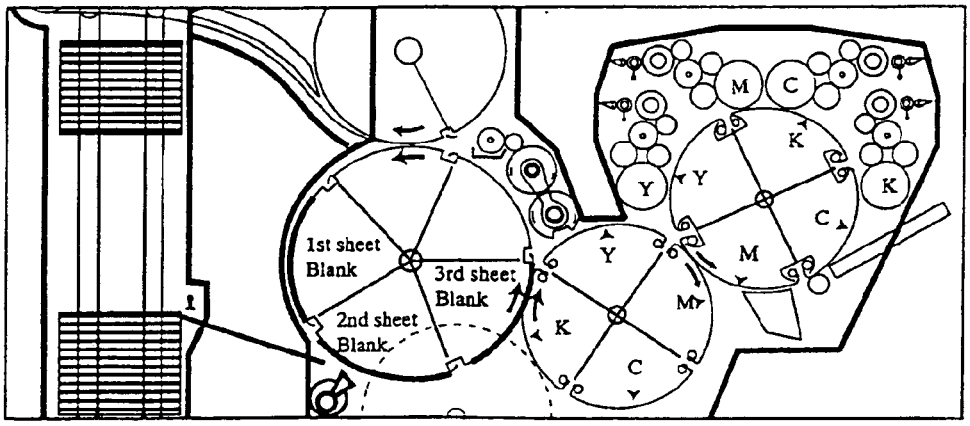
Figure 5J:
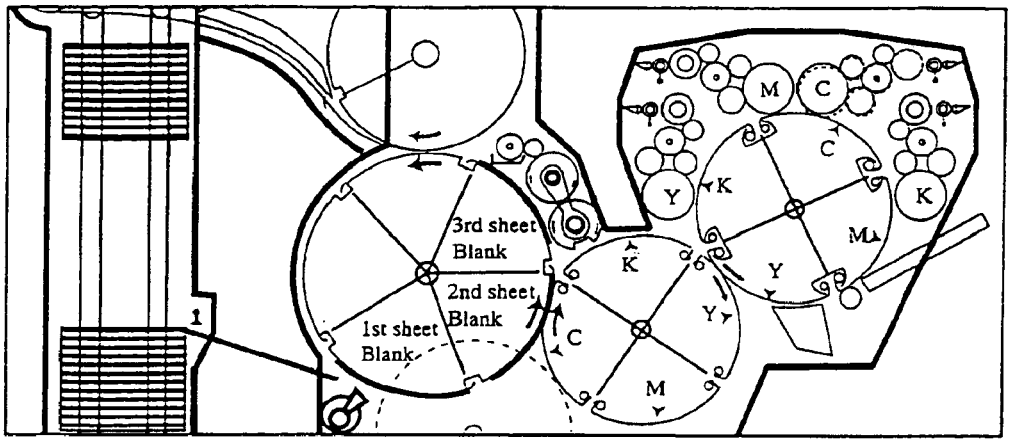

At FIG. 5I, the third print media 31 continues and the yellow inking unit 29Y applies ink to the yellow plate image segment 44Y. When the yellow plate segment 44Y meets the blanket cylinder 42Y, the plate to blanket impression is engaged for transferring the inked plate segment 44Y to an associated blanket segment 42Y, in FIG. 5J. The color image is offset, as known in the industry, when it is transferred onto the associated blanket segment 42Y. Meanwhile, the cyan plate image segment 44C receives ink from the cyan inking unit 29C, followed by the magenta plate image segment 44M receiving ink from the magenta inking unit 29M.

Figure 5K:
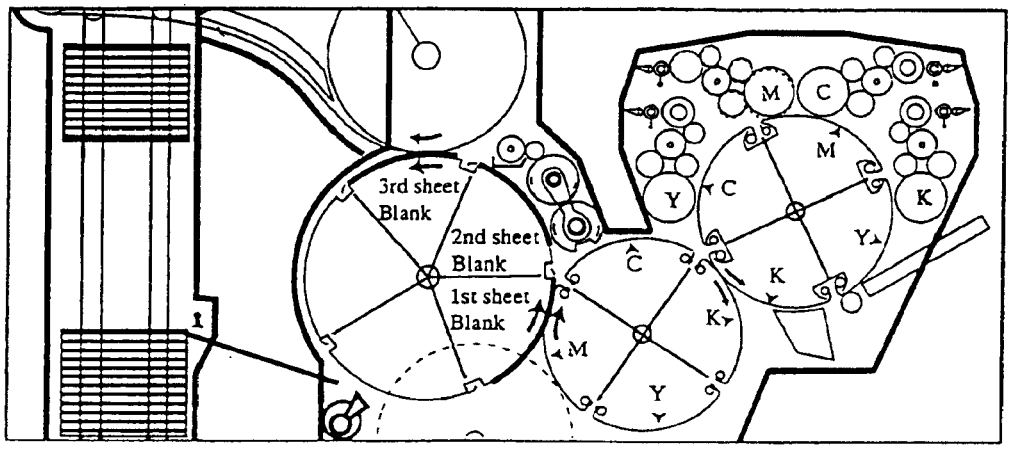
Figure 5L:
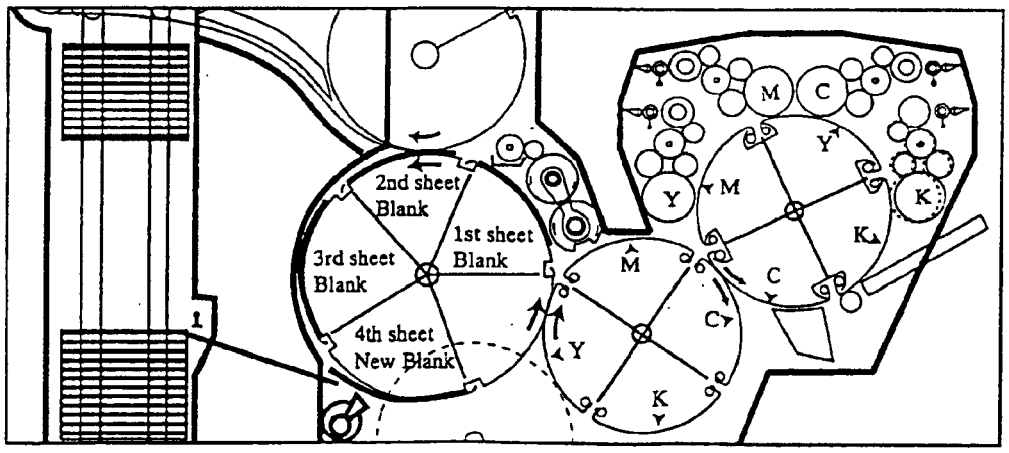
Figure 5M:
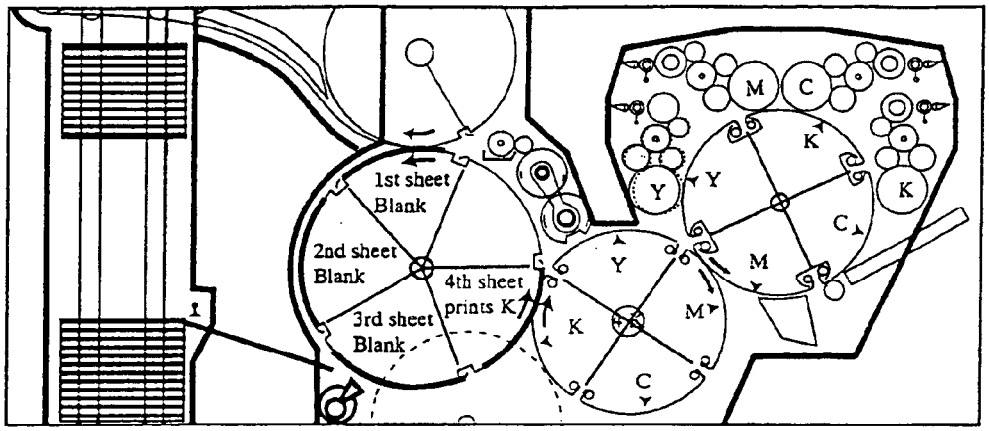

Immediately thereafter, FIGS. 5K–5L, after the black plate segment 44K has been transferred to the associated blanket segment 42K, a fourth print media is fed after another four-segment rotation of the impression cylinder 30. The fourth print media is transferred to the image segment preceding the third print media on the impression cylinder 30. Impression cylinder 30 contacts the blanket segment 42K during the start of the fourth rotation of the black blanket segment 42K. Accordingly, as the black blanket segment 42K rotates along the fourth print media carried by the impression cylinder 30, the black color image is transferred onto the fourth print media, FIG. 5M.

Figure 5N:
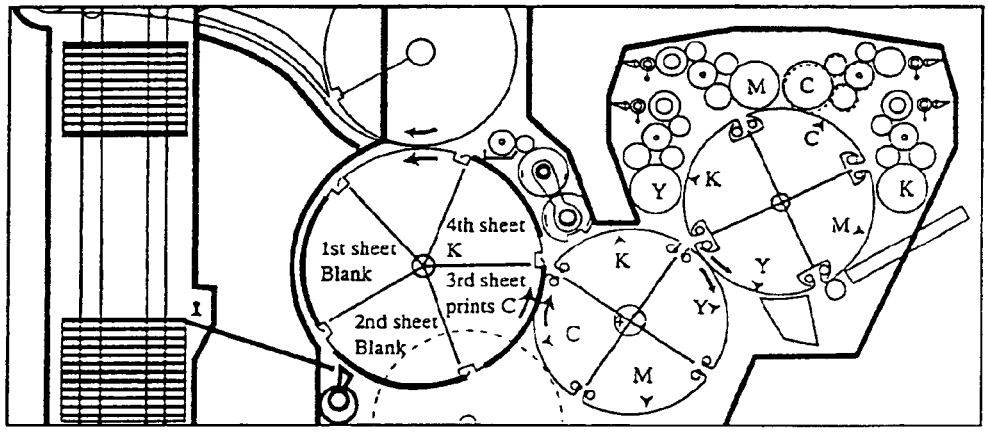

Immediately thereafter, FIG. 5N, the cyan blanket segment 42C transfers the associated image onto the third print media 31 gripped one the impression cylinder 30. Almost simultaneously, the cyan plate image segment 44C is receiving ink thereon by the corresponding inking unit 29C. After the transfer of the cyan image 42C onto the third print media 31, the associated inking unit inks the magenta plate image 44M and the previously offset magenta color image on the blanket cylinder 35 is transferred to the second print media 31 on the impression cylinder, FIGS. 5N–5O.

Thus, from the beginning of the fourth rotation, this system is synchronized so that as the cyan and magenta plate image segments 44C, 44M are being inked by their associated inking units, the cyan and magenta blanket image segments 42C, 42M are being transferred onto a printable media held by the impression cylinder 30. Conversely, as the yellow and black plate image segments 44Y, 44K are being inked by their associated inking units, the black and yellow blanket image segments 42K, 42Y are being transferred onto a printable media held by the impression cylinder 30.

Figure 5O:
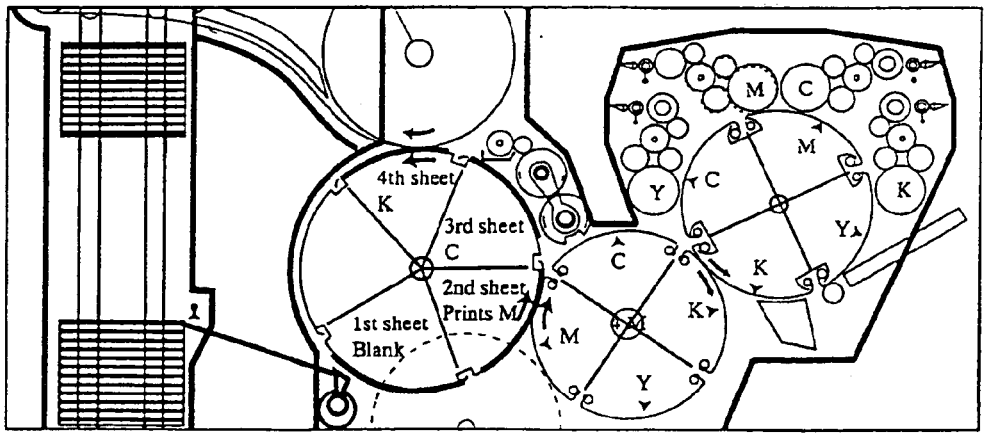
Figure 5P:
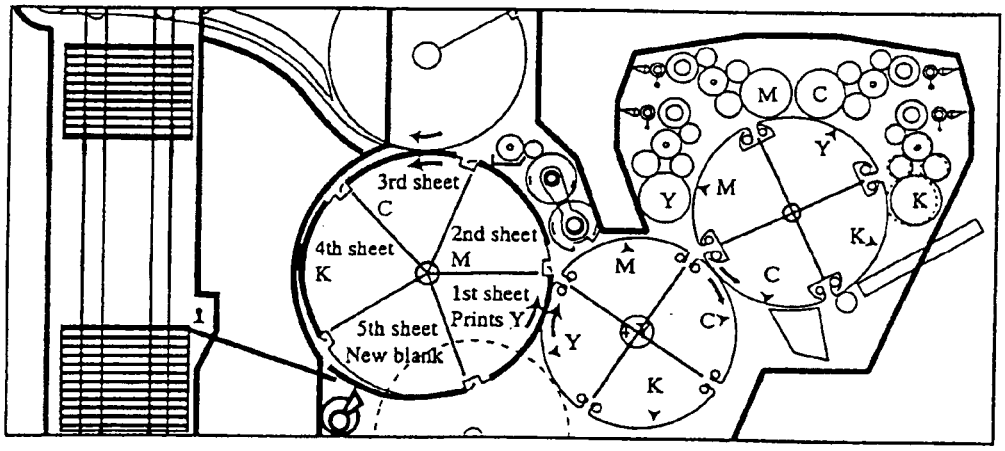
Figure 5Q:
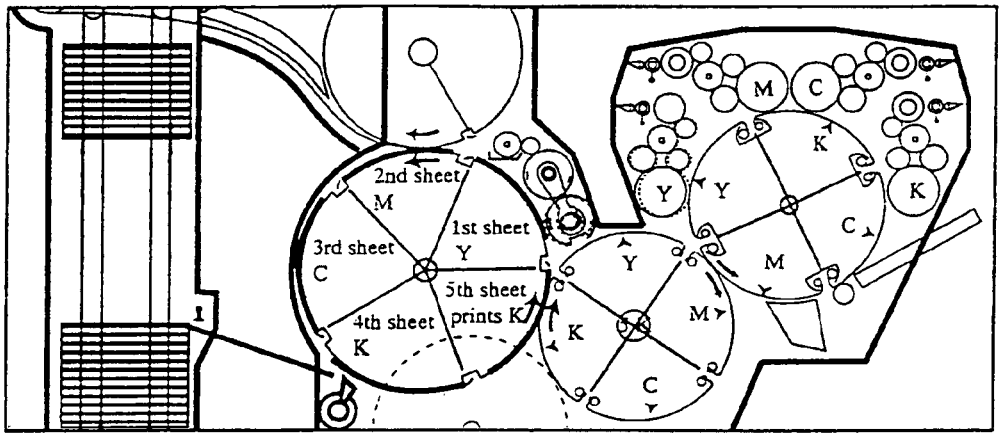

As 42K is being transferred onto the fourth print media, FIG. 5O, the magenta inking unit 29M is applying ink onto the plate image segment 44M to be transferred onto the magenta blanket segment 42M. During the fourth rotation of the blanket cylinder 35, a new print media ($5^{th}$ sheet) is fed to occupy the next available segment on the impression cylinder 30, FIG. 5P. During this time, the yellow blanket image 42Y is being transferred onto the first printable media carried by the cylinder 30 and the black inking unit 29K is applying ink to the black plate image segment 44K.

The fifth rotation of the blanket cylinder 35 begins with the fifth print media receiving the black blanket image 42K and the yellow plate image segment 44Y receiving ink from its associated inking unit, followed by the yellow plate image segment 44Y from its associated inking unit. Also delivery of the first print media to delivery gripper system 59 to be transported into the delivery tray 65 is begun.

Thus, the delivery gripper system directs the first print media past the disengaged coating device 63, off of the impression cylinder 30 and past the disengaged dryer for delivery into the delivery tray 65. This first delivered print media contains only the yellow image impressed thereon and should be discarded as an unfinished product.

Figure 5R:
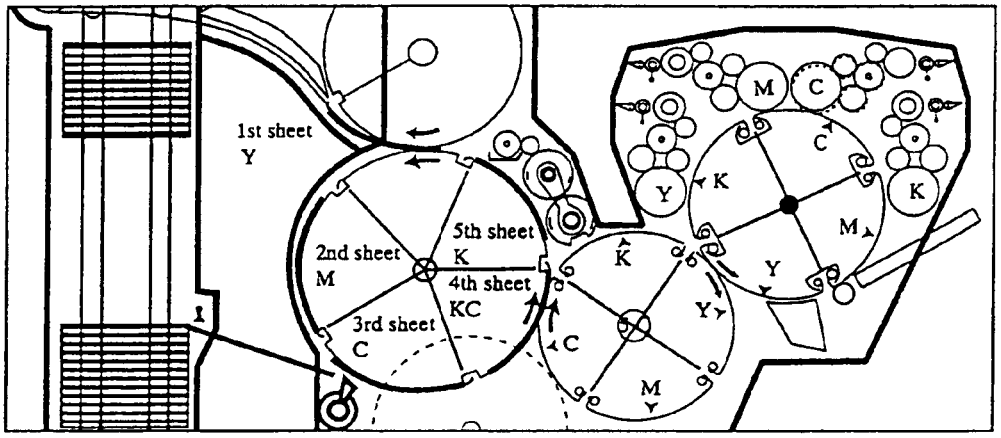
Figure 5S:
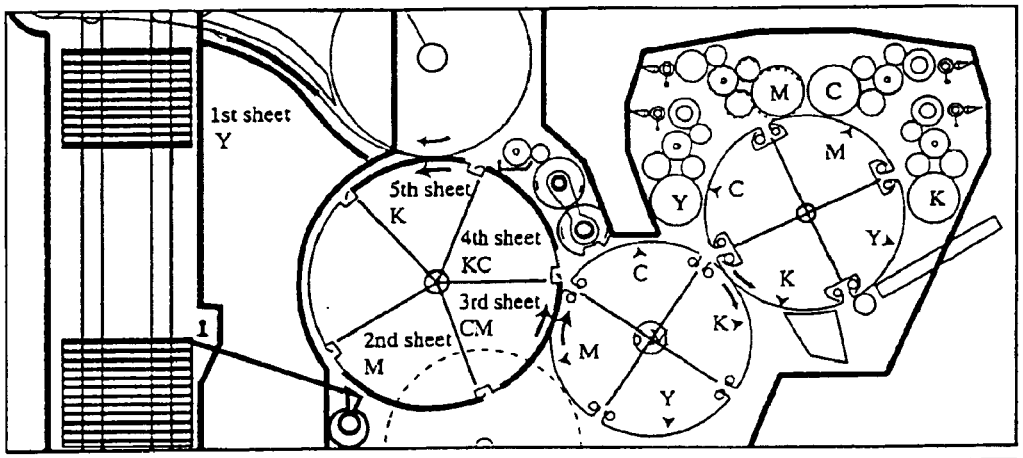

Meanwhile, FIGS. 5R, 5S, the fourth sheet receives the cyan blanket image while the cyan plate image segment is inked by its associated inking unit. Immediately thereafter, the third sheet receives the magenta color image while the magenta inking unit inks the magenta plate image segment.

Figure 5T:
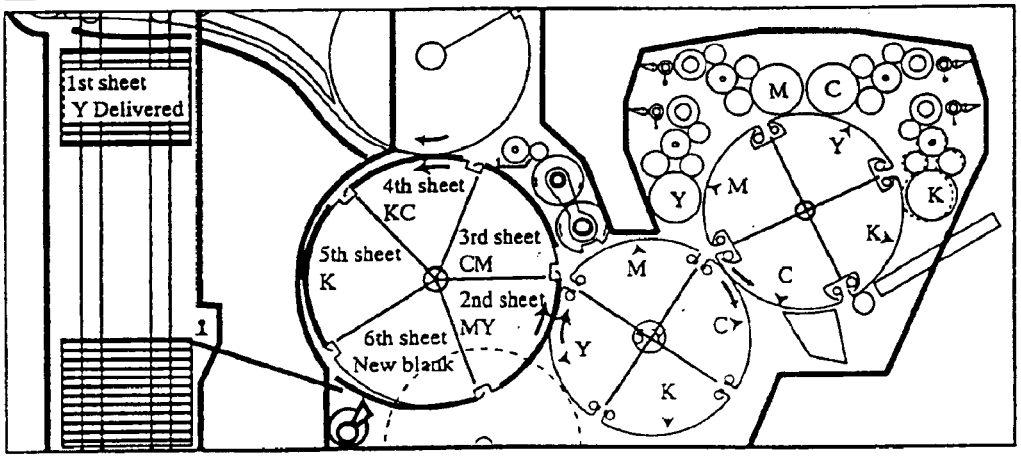

The cyan blanket image 42C is now being transferred onto the fourth print media gripped on the impression cylinder 30, FIG. 5R, and the cyan plate image segment 44C is being inked by its associated inking unit. This is followed by the magenta blanket image segment 42M being transferred onto the third print media gripped on the impression cylinder 30, FIG. 5S, while the magenta plate image segment 44M is being inked by its associated inking unit. The fourth print media now has the black 42K and the cyan 42C images impressed thereon, the third print media has the cyan 42C and the magenta 42M images impressed thereon, and the second print media has the magenta 42M and the yellow 42Y images impressed thereon, FIG. 5T.

Figure 5U:
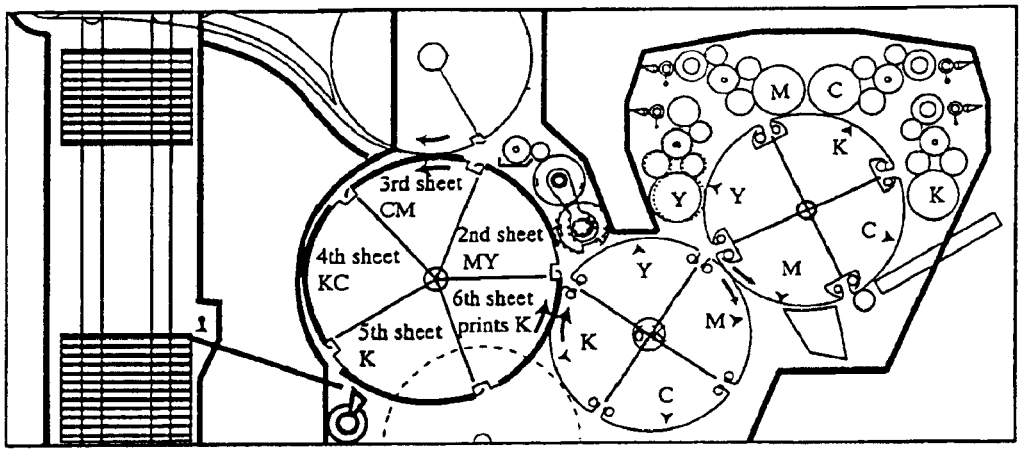

After yellow blanket image 42Y is transferred onto the second print media and a new sixth print media has been fed to the impression cylinder segment immediately following the second print media, the black image color 42K is impressed onto the sixth print media as the yellow inking unit inks the yellow plate image segment 44Y, FIG. 5U.

Figure 5V:
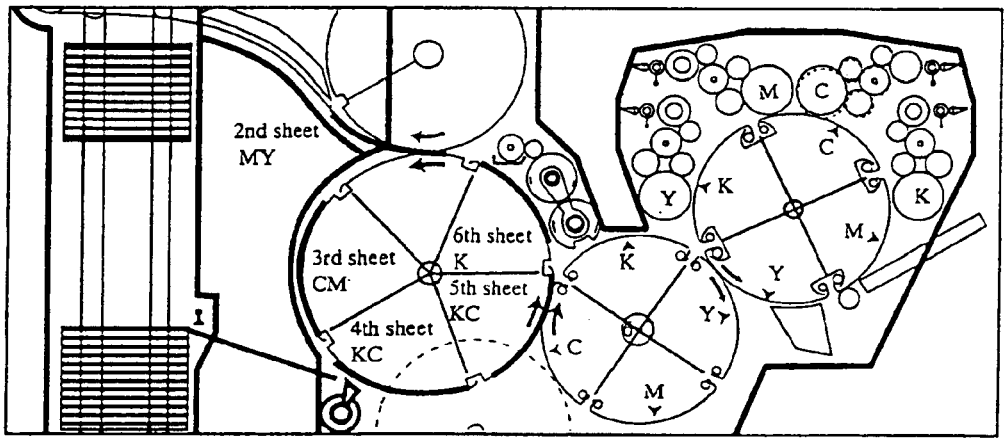
Figure 5W:
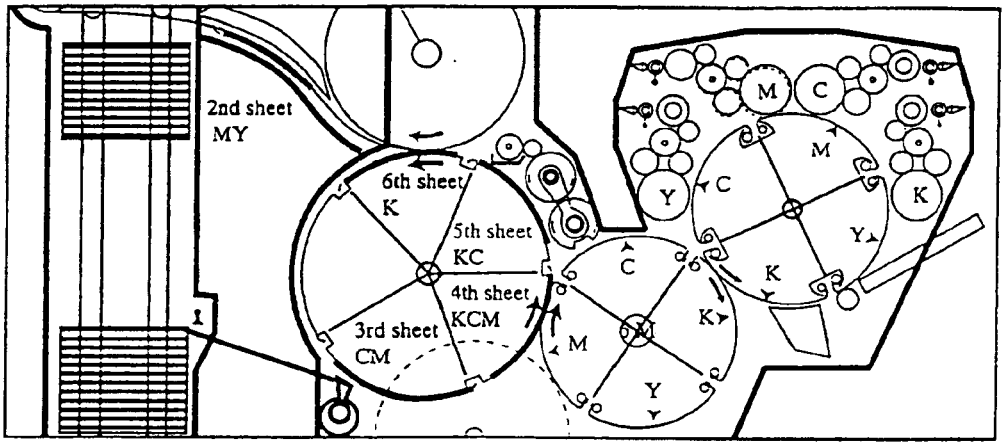
Figure 5X:
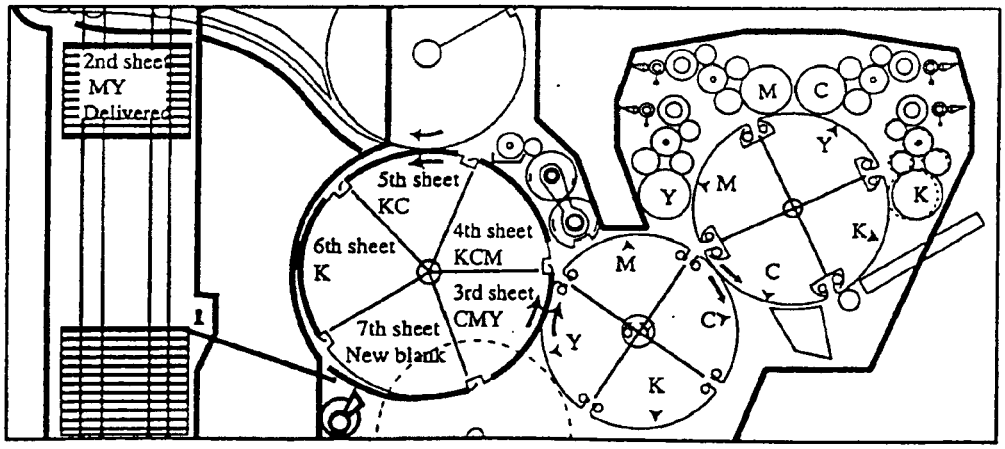
Figure 5Y:
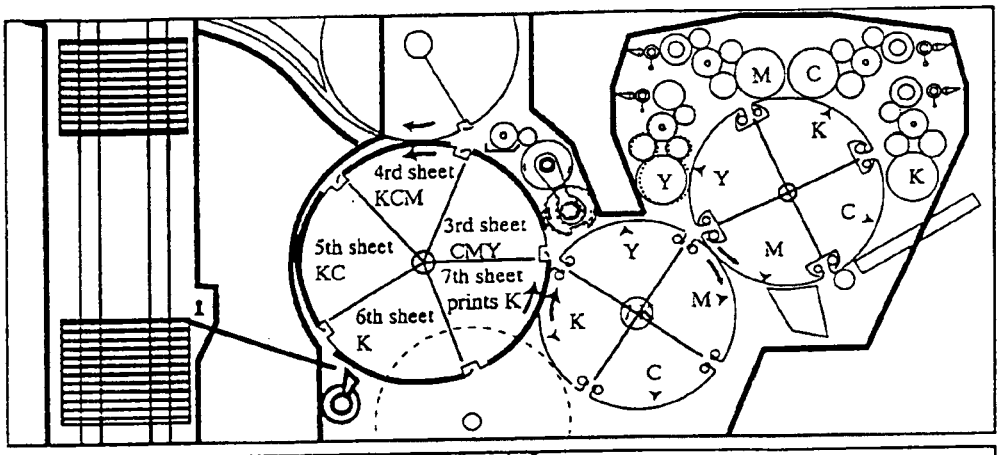
Figure 5Z:
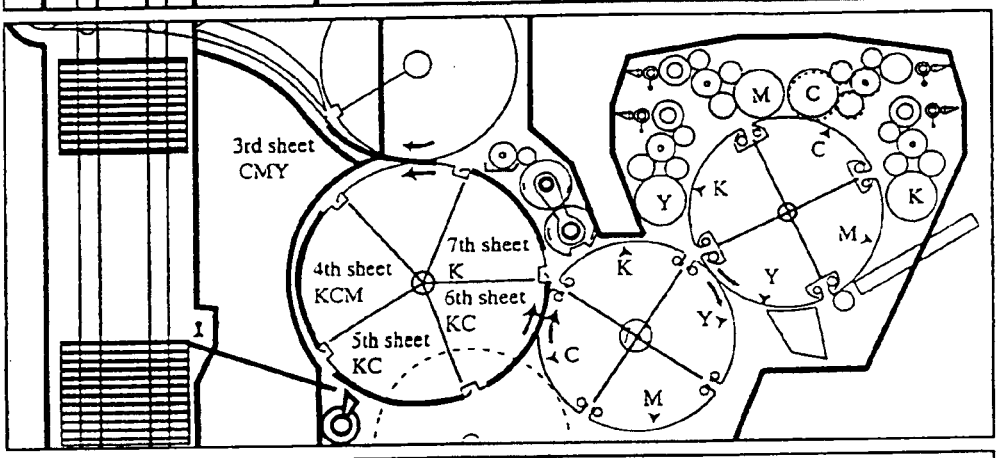
Figure 5A:
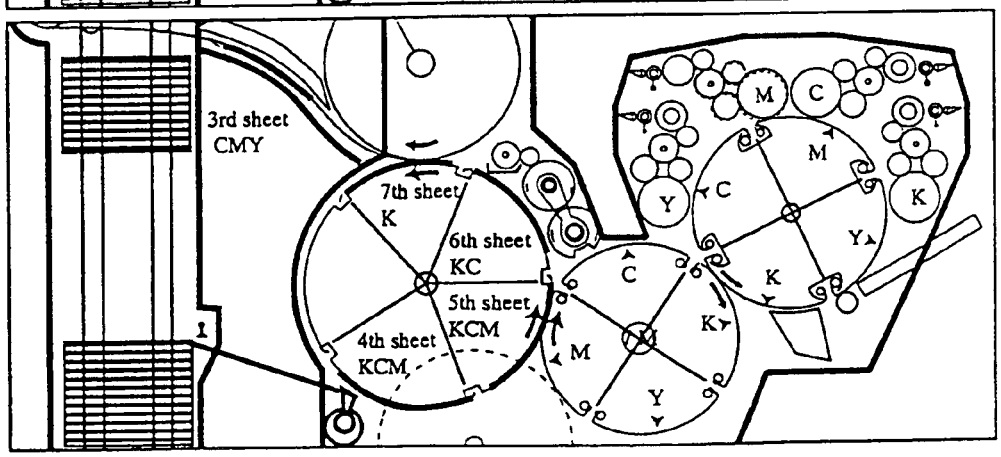
Figure 5B:
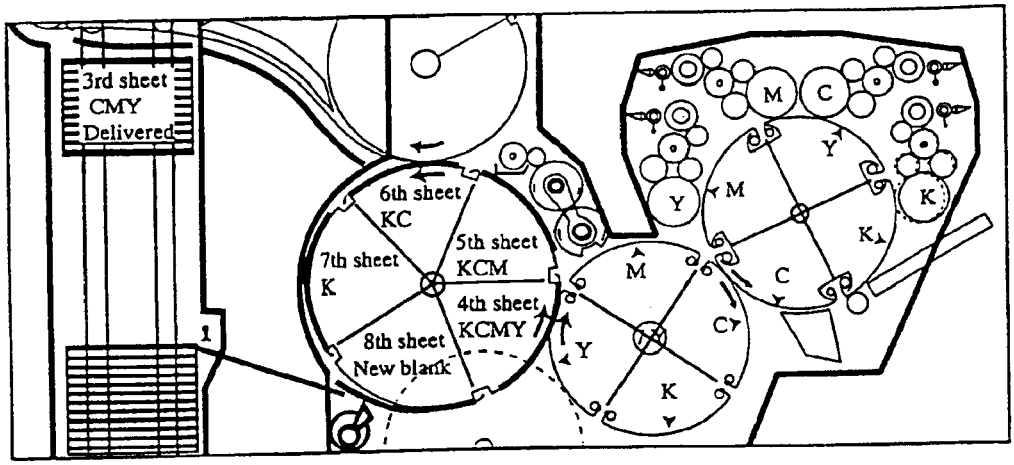
Figure 5C:
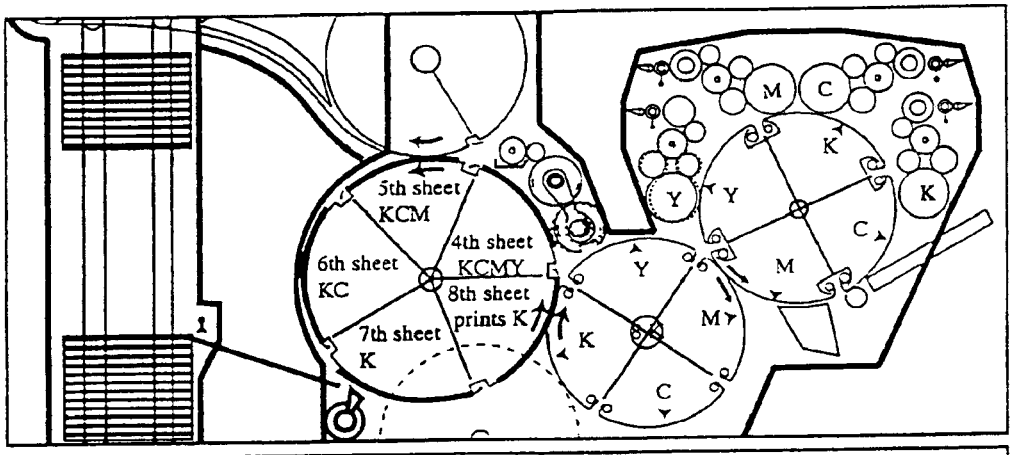
Figure 5D:
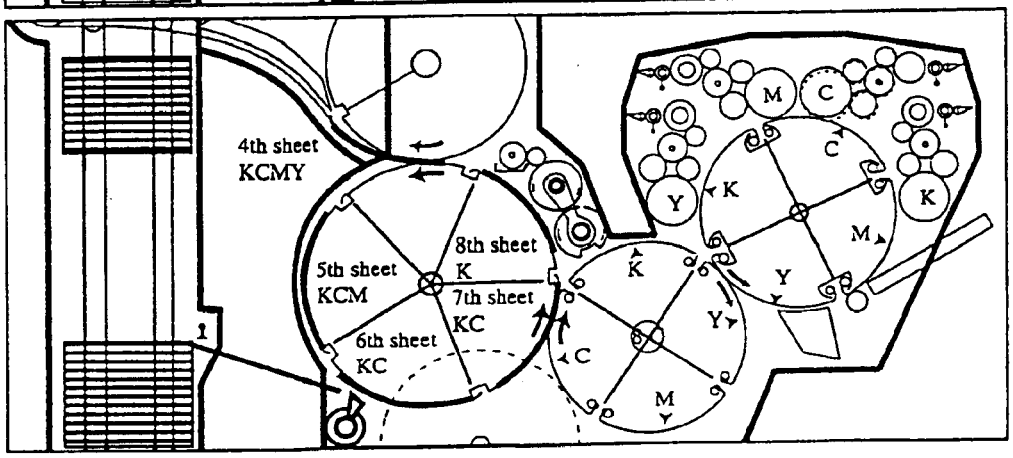
Figure 5E:
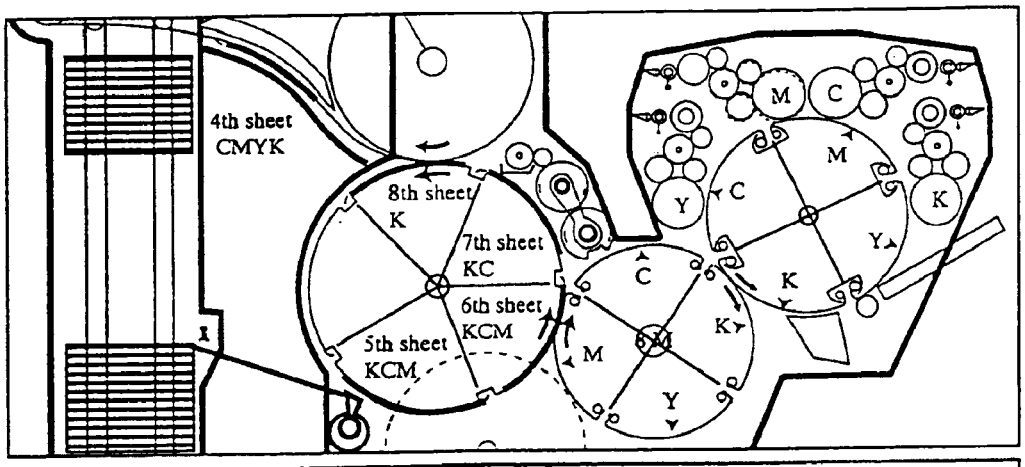
Figure 5F:
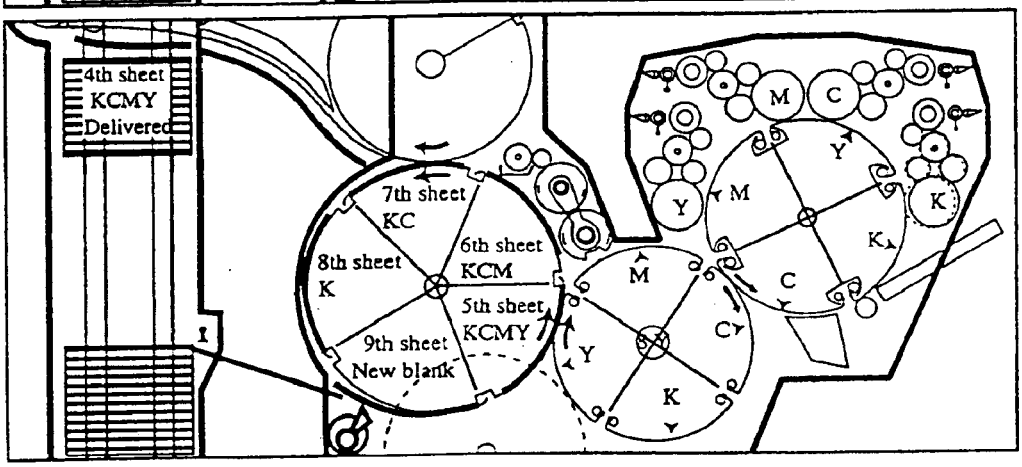
Figure 5G:
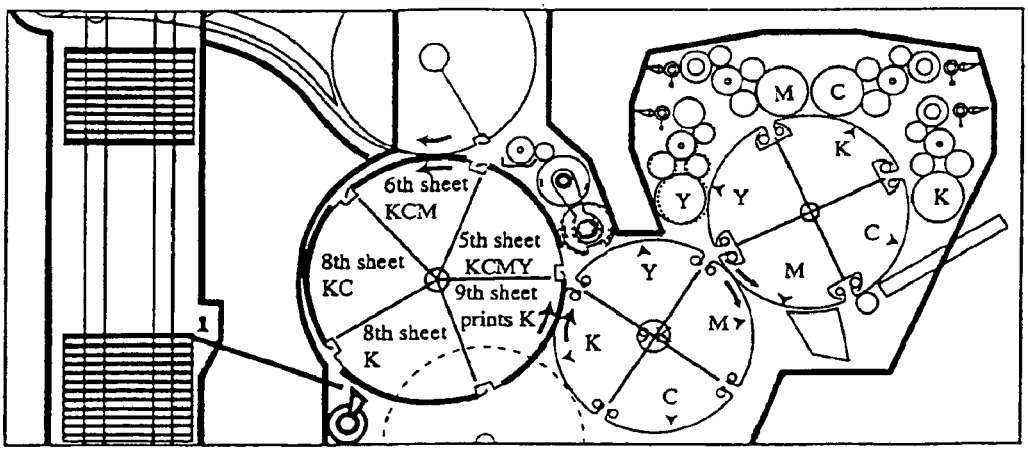
Figure 5H:
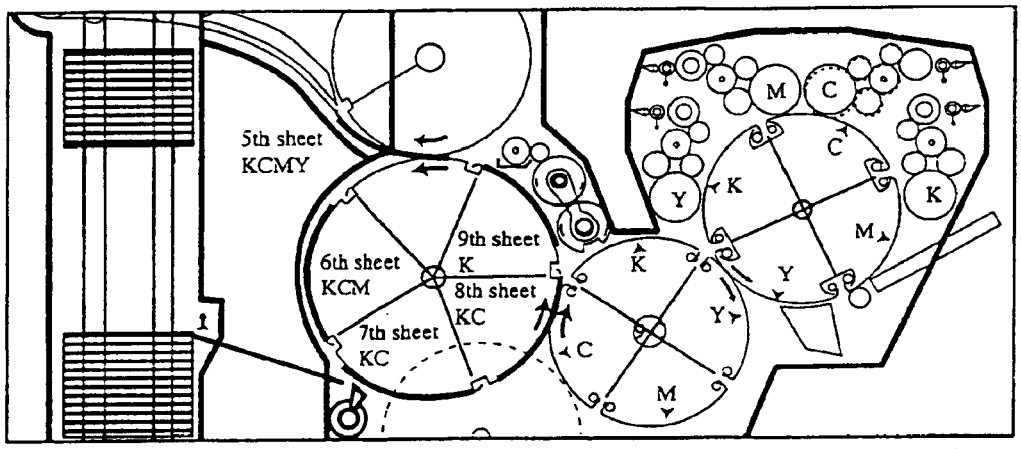
Figure 5I:
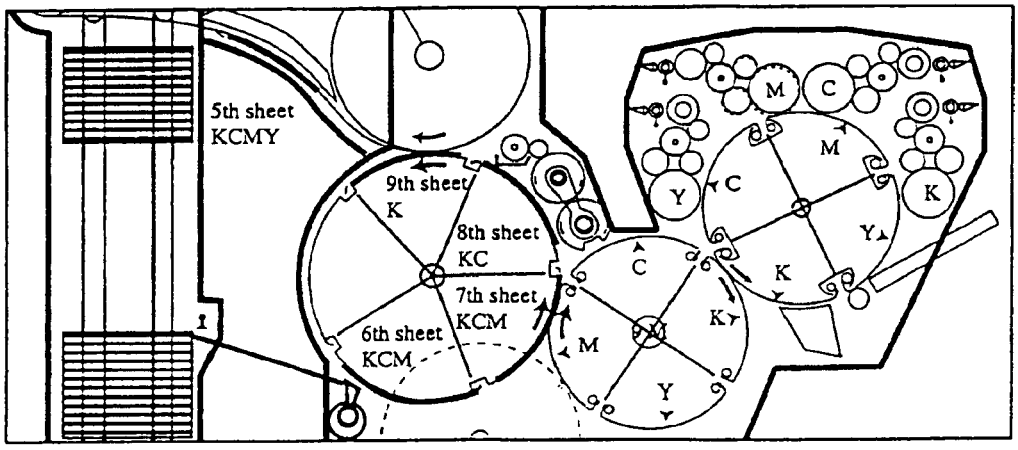
Figure 5J:
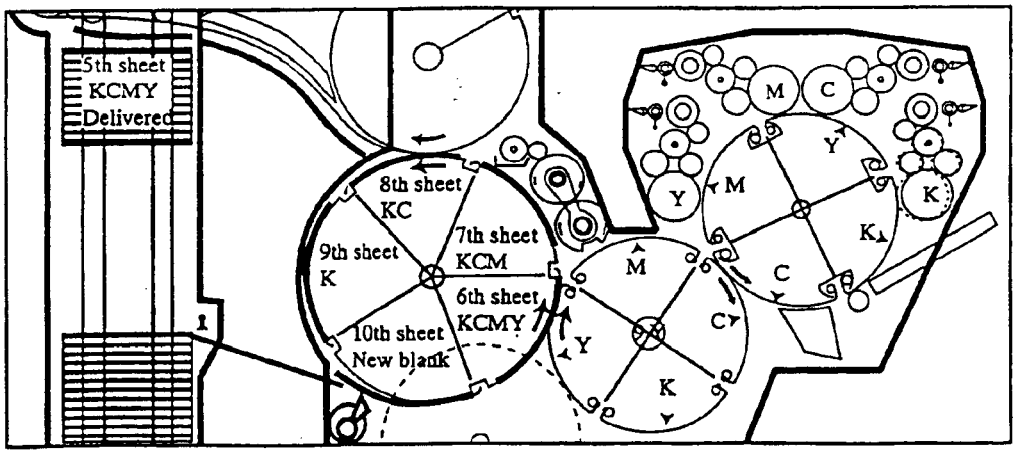

Immediately thereafter, FIG. 5V, the second print media is removed from the impression cylinder 30 by the delivery system, the fifth print media receives a cyan color image and the cyan plate image segment 44C is inked by its associated inking unit. At FIG. 5W, the second sheet continues it path on delivery chain 39 past the dryer 68 as the fourth print media receives a magenta color image and the magenta plate image segment 44M is inked by its associated inking unit. Now, the second print media is delivered into tray 65 as the third sheet receives a yellow color image and the black plate image segment 44K is inked by its associated inking unit. The second print media should be discarded because it only contains magenta and yellow color images.

These described processes are repeated, so that a third print media with cyan, magenta and yellow color images thereon, is delivered into tray 65. Such a third should be discarded. After eight complete rotations (32 image segments) of the blanket cylinder 35, the first complete printed media 51, represented by the fourth sheet, is printed with four colors, FIG. 5*b*. This fourth sheet gets delivered to the gripper system 59 immediately after the coater device 63 coats the printed media, as needed. Such a coater 63 disengages from the impression cylinder 30 after the fourth sheet has passed by the coating device 63.

A new print media 31 is fed to take its place and acts as the newest print media, ninth sheet as shown in FIG. 5*f* on the impression cylinder 30. The first color image printed on this new print media is the black "K" segment, as is with all new print media according to the present embodiment. The yellow image is the last image applied on print media before being delivered to the delivery system 57. After the first printed media 51 having four color images impressed thereon reaches the delivery system 57, fourth sheet, each succeeding printed media 51 will be produced after each revolution of the plate and blanket cylinders 27, 35, which corresponds to 4/5 revolution of the impression cylinder 30, as shown in the subsequent FIGS.

The order of transferring the color images onto a printable media is "K, C, M, Y". Of course, other embodiments may transfer such colors in a different order. Whether the present color order is chosen or a different color order, the color order will always be consistent until changed by an operator. Because each print media 31 receives only one color image per rotation of the impression cylinder 30, such print media are provided with extended time to dry before the next color image is applied thereon.

While a preferred embodiment of a three-cylinder multicolor offset rotary printing machine in accordance with the present invention has been set forth fully and completely hereinabove, it will be apparent to one of skill in the art that a number of changes, for example, in the overall drive for the printing machine, the speed of operation of the machine, the type of print media print media 31 being provided, and the like can be made without departing from the true spirit and scope of the present invention.

What is claimed as new and what it is desired to secure by Letters Patent of the United States is:

1. A color printing press comprising: a single rotatable blanket cylinder having four image segments; a single rotatable plate cylinder having four image segments each selectively engagable with associated said blanket image segments; an image forming system adjacent to said plate cylinder and for forming an image on each said plate image segments; an inking unit for each said plate image segments and for selectively supplying a different color ink to respective said plate image segments; and a single rotatable impression cylinder having five image segments each including a gripper system for carrying a print media to receive an image thereon from at least one of said blanket image segments; said impression and plate cylinders being rotatable in a one direction and opposite to rotation of said blanket cylinder.

2. The printing press of claim 1, wherein said blanket cylinder further comprises a pair of eccentric bushings at opposite ends thereof, said eccentric bushings having limited rotation to simultaneously move said blanket cylinder into engagement with said impression and plate cylinders.

3. The printing press of claim 1, further comprising: an axel extending through a longitudinal axis of said impression cylinder and journaled at opposite ends thereof; a pair of spaced bushings at opposite ends of said axel; a pair of spaced eccentric bushings adjacent a perimeter of said impression cylinder; and a generally arcuate support member cooperating with said axel and said pair of bushings and said pair of eccentric bushings so that said pair of eccentric bushings moves said impression cylinder into engagement with said blanket cylinder; said impression cylinder being engagable against said blanket cylinder after said blanket cylinder engages said plate cylinder.

4. The printing press of claim 1, wherein each said inking unit includes a plurality of rollers cooperating with each other so that one said plurality of rollers selectively engages one associated said plate image segment.

5. The printing press of claim 4, wherein said one roller of each said inking units being a form roller having a circumferential length substantially equal to a circumferential length of each said associated plate image segments.

6. The printing press of claim 1, wherein said inking units are oriented in a generally satellitic path around about 180 degrees periphery of said plate cylinder remote from said blanket cylinder.

7. The printing press of claim 1, wherein said image forming system includes an imaging unit adjacent said plate cylinder for creating an image on each said plate image segments during one rotation of the plate cylinder.

8. The printing press of claim 7, wherein said imaging unit is generally between one said inking units and said blanket cylinder.

9. The printing press of claim 1, further comprising a coating apparatus for applying an aqueous solution on printed media after receiving a predetermined number of color images thereon and prior to discharge from said impression cylinder.

10. The printing press of claim 1, wherein a longitudinal axis of said plate cylinder is above a longitudinal axis of said blanket cylinder which is above a longitudinal axis of impression said cylinder.

11. The printing press of claim 1, wherein said feed and delivery systems are located generally on opposite sides of said printing press.

12. The printing press of claim 1, further comprising a print media feed system and a printed media delivery system being disposed generally above said feed system and located adjacent said impression cylinder, said feed system transporting print media to said impression cylinder and said delivery system receiving and discharging printed media from said impression cylinder.

13. The printing press of claim 12, further comprising a dryer adjacent said delivery system for drying said aqueous solution before said delivery system releases printed media.

14. The printing press of claim 12, wherein said feed and delivery systems being located generally on the same side of said printing press adjacent said impression cylinder.

15. The printing press of claim 12, wherein said feed and delivery systems respectively further include a feeder tray and a delivery tray located generally thereabove; and means for connecting each of said trays for vertical movement, said feeder tray being movable upwardly to dispose print media into position for entering and attaching to said impression cylinder and said delivery tray being movable downwardly as printed media is deposited on said delivery tray.

16. The printing press of claim 12, wherein said delivery system further includes a pair of rotatable cylinders; a delivery chain connecting said pair of rotatable cylinders; and a plurality of gripper systems so that a first one of said plurality of gripper systems being attached to one said pair of cylinders cooperating with said impression cylinder for removing printed media therefrom, a second one of said pair of plurality of gripper systems being attached to said delivery chain for delivering printed media to said delivery tray.

17. The printing press of claim 1, wherein each said blanket and plate image segments has substantially the same circumferential length.

18. The printing press of claim 1, wherein a longitudinal axis of said plate cylinder is above a longitudinal axis of said impression cylinder which is above a longitudinal axis of said blanket cylinder.

19. The printing press of claim 1, further comprising a machine frame housing said press and being approximately 10.7 feet long, 3.5 feet wide, and 6.5 feet high for allowing operator access to said press.

20. The printing press of claim 19, further comprising at least one door movably attached to said frame for accessing select components of said press when said door is at an open position.

21. A color printing press including a rotatable plate cylinder, a rotatable blanket cylinder, an image forming system adjacent to said plate cylinder for forming images on said plate cylinder, a plurality of inking units for supplying different color inks to said plate cylinder which inks are transferred to said blanket cylinder, and a rotatable impression cylinder for carrying printable media to receive printed images thereon from said blanket cylinder, said printing press comprising: each of said plate and blanket cylinders having four segments and said impression cylinder having five segments, said impression and plate cylinders being engagable with said blanket cylinder located therebetween and rotatable in one direction opposite to rotation of said blanket cylinder, said plate and blanket cylinders having respective longitudinal and parallel axes and forming an angle of about 120 degrees with said plate cylinder axis being an apex.

22. The printing press of claim 21, further comprising a coating apparatus adjacent said impression and blanket cylinders for selectively applying an aqueous solution on printed media prior to same being discharged from said impression cylinder.

23. The printing press of claim 21, further comprising a print media feed system and a printed media delivery system being disposed generally above said feed system and located adjacent said impression cylinder, said feed system for transporting print media to said press and said delivery system for discharging and receiving printed media from said press.

24. The printing press of claim 21, further comprising a dryer adjacent said delivery chain and for drying said aqueous solution before said delivery system discharges printed media.

25. The printing press of claim 21, further comprising a machine frame housing said press and being approximately 10.7 feet long, 3.5 feet wide, and 6.5 feet high for allowing access to said press.

26. The printing press of claim 25, further comprising at least one door movably attached to said frame for accessing components of said press when said door is at an open position.

* * * * *